US011091958B2

(12) United States Patent
Wanta et al.

(10) Patent No.: US 11,091,958 B2
(45) Date of Patent: Aug. 17, 2021

(54) SHELF ELECTRICAL SIGNAL CONNECTOR

(71) Applicant: Sub-Zero, Inc., Madison, WI (US)

(72) Inventors: Keith R. Wanta, New Glarus, WI (US); Colin M. Hasburgh, Stoughton, WI (US); Sean T. Petersen, Evansville, WI (US)

(73) Assignee: SUB-ZERO GROUP, INC., Madison, WI (US)

( * ) Notice: Subject to any disclaimer, the term of this patent is extended or adjusted under 35 U.S.C. 154(b) by 330 days.

(21) Appl. No.: 16/242,223

(22) Filed: Jan. 8, 2019

(65) Prior Publication Data

US 2019/0211627 A1 Jul. 11, 2019

Related U.S. Application Data

(60) Provisional application No. 62/615,545, filed on Jan. 10, 2018.

(51) Int. Cl.

| | |
|---|---|
| ***H01R 4/60*** | (2006.01) |
| ***E06C 9/02*** | (2006.01) |
| ***H01R 13/17*** | (2006.01) |
| ***H01R 4/02*** | (2006.01) |
| ***H01R 13/24*** | (2006.01) |
| *H01R 25/16* | (2006.01) |

(52) U.S. Cl.

CPC ..... *E06C 9/02* (2013.01); *H01R 4/023* (2013.01); *H01R 13/17* (2013.01); *H01R 13/24* (2013.01); *H01R 25/167* (2013.01)

(58) Field of Classification Search

CPC ..... F25D 27/00; H01R 4/023; H01R 13/17

USPC ..... 700/700, 110; 362/133

See application file for complete search history.

(56) References Cited

U.S. PATENT DOCUMENTS

| | | | | |
|---|---|---|---|---|
| 3,506,325 | A * | 4/1970 | Horvay | F25D 25/02 312/223.5 |
| 5,022,720 | A * | 6/1991 | Fevig | A47F 3/005 108/107 |
| 5,348,485 | A * | 9/1994 | Briechle | H01R 25/14 439/110 |
| 5,994,644 | A * | 11/1999 | Rindoks | A47B 21/06 108/50.02 |
| 6,042,244 | A * | 3/2000 | Witkoski | A47F 5/0043 362/125 |

(Continued)

OTHER PUBLICATIONS

Spring-Loaded Connectors/Pogo pins connectors, Product Listing, 2 pages. Printed from the internet: http://www.precipid.com/AppHost/9695,1/Scripts/Modules/Catalog/Default.aspx?c=11, Jan. 22, 2019.

*Primary Examiner* — Neil Abrams
(74) *Attorney, Agent, or Firm* — Bell & Manning, LLC

(57) ABSTRACT

A shelf electrical signal connector is provided that includes a ladder connector and a shelf connector. The ladder connector mounts to a ladder of a shelving system and includes a spring-loaded contact pin formed of an electrically conductive material and electrically connected to a first wire configured to carry an electrical signal. The shelf connector mounts to a shelf bracket and includes a contact pad formed of an electrically conductive material that is connected to a second wire. The contact pad abuts and rests on the spring-loaded contact pin to electrically connect the first wire to the second wire when the shelf bracket is mounted to the ladder of the shelving system.

20 Claims, 30 Drawing Sheets

(56) References Cited

U.S. PATENT DOCUMENTS 6,231,205 B1 * 5/2001 Slesinger ..... A47B 96/02 362/125
6,364,678 B1 * 4/2002 Hellwig ..... H02G 3/0493 439/207
6,527,565 B1 * 3/2003 Johns ..... H01R 25/14 362/418
6,650,532 B2 * 11/2003 Shin ..... G06F 1/1632 361/679.27
6,813,896 B1 * 11/2004 Janke ..... F25D 25/02 62/126
7,107,779 B2 * 9/2006 Avenwedde ..... F21V 23/06 362/92
7,163,305 B2 * 1/2007 Bienick ..... A47F 5/0043 362/92
7,651,368 B2 * 1/2010 Kendall ..... H01R 27/02 439/527
7,716,408 B2 * 5/2010 Bhatia ..... G06F 1/189 710/304
7,766,502 B2 * 8/2010 Tress ..... F21V 33/0012 362/125
8,299,656 B2 * 10/2012 Allard ..... F16M 13/02 307/154
8,657,392 B2 * 2/2014 Fabbro ..... H01F 38/14 312/408
8,739,568 B2 * 6/2014 Allard ..... F25D 23/12 62/448
8,967,740 B2 * 3/2015 Kerner ..... H01R 13/701 312/237
8,979,296 B2 * 3/2015 Wiemer ..... A47F 5/103 362/125
9,033,717 B2 * 5/2015 Allard ..... H01R 13/72 439/131
9,098,823 B2 * 8/2015 Slesinger ..... A47B 96/021
9,130,326 B2 * 9/2015 Meis ..... A47B 97/00
9,130,327 B2 * 9/2015 Flynn ..... H01R 13/64
9,455,506 B2 9/2016 Kerner
9,537,274 B1 * 1/2017 Dankelmann ..... A47F 5/0043
9,541,328 B2 1/2017 Kerner et al.
9,596,950 B2 * 3/2017 Waalkes ..... A47F 7/02
9,831,642 B2 * 11/2017 Woodley ..... A47B 97/00
9,883,756 B2 * 2/2018 Kraiss ..... A47F 11/10
9,989,298 B1 * 6/2018 Wantland ..... A47B 96/061
10,184,622 B2 * 1/2019 Dong ..... F21V 33/0012
10,274,670 B2 * 4/2019 Lee ..... F25D 27/00
2006/0087207 A1 * 4/2006 Oh ..... A47B 51/00 312/402
2007/0202734 A1 * 8/2007 Fugger ..... A47J 31/4403 439/369
2008/0043456 A1 * 2/2008 Bernardini ..... F25D 25/02 362/94
2008/0139054 A1 * 6/2008 Williamson ..... H01R 35/04 439/801
2019/0211627 A1 * 7/2019 Wanta ..... H01R 13/24
2019/0301791 A1 * 10/2019 Wantland ..... F25D 23/067

* cited by examiner

SHELF ELECTRICAL SIGNAL CONNECTOR

CROSS-REFERENCE TO RELATED APPLICATIONS

The present application claims the benefit of 35 U.S.C. § 119(e) to U.S. Provisional Patent Application No. 62/615,545 filed Jan. 10, 2018, the entire contents of which are hereby incorporated by reference.

BACKGROUND

Objects that use an electrical signal, such as for power or for data transmission, may be associated with a shelving system. Electrical connection systems that provide the electrical signal to such objects should provide a safe and reliable electrical connection that is preferably easy to manufacture and to mount in the shelving system in a visually unobtrusive manner.

SUMMARY

In an example embodiment, a shelf electrical signal connector is provided that includes a ladder connector and a shelf connector. The ladder connector mounts to a ladder of a shelving system and includes a spring-loaded contact pin formed of an electrically conductive material and electrically connected to a first wire configured to carry an electrical signal. The shelf connector mounts to a shelf bracket and includes a contact pad formed of an electrically conductive material that is connected to a second wire. The contact pad abuts and rests on the spring-loaded contact pin to electrically connect the first wire to the second wire when the shelf bracket is mounted to the ladder of the shelving system.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

The described system provides an electrical signal such as a power signal or a data signal to a shelf through a connector mounted to a ladder to which the shelf is mounted. The power signal may provide power to one or more objects connected to receive the power signal such as a light, a display, a heater, a sensor, a speaker, a camera, etc. The powered object may be mounted to or adjacent to the shelf. The data signal may send data to and/or receive data from the one or more powered object or one or more other objects that may be mounted to or adjacent to the shelf such as the light, the display, the heater, the sensor, the speaker, the camera, etc. The data signal may include any type of information and may be encoded in a communication signal in various manners as understood by a person of skill in the art. The electrical signal may be continuous, intermittent, periodic, when triggered by decision logic, etc. depending on the application.

Each sensor may be associated with a different device and/or type of device. Example sensor types include a pressure sensor, a temperature sensor, a position sensor, a fluid flow rate sensor, a voltage sensor, a current sensor, a frequency sensor, a phase angle sensor, a data rate sensor, a humidity sensor, an acoustic sensor, a light sensor, a motion sensor, a force sensor, a torque sensor, a load sensor, a strain sensor, a chemical property sensor, etc. that may be mounted to various devices.

Figure 1:
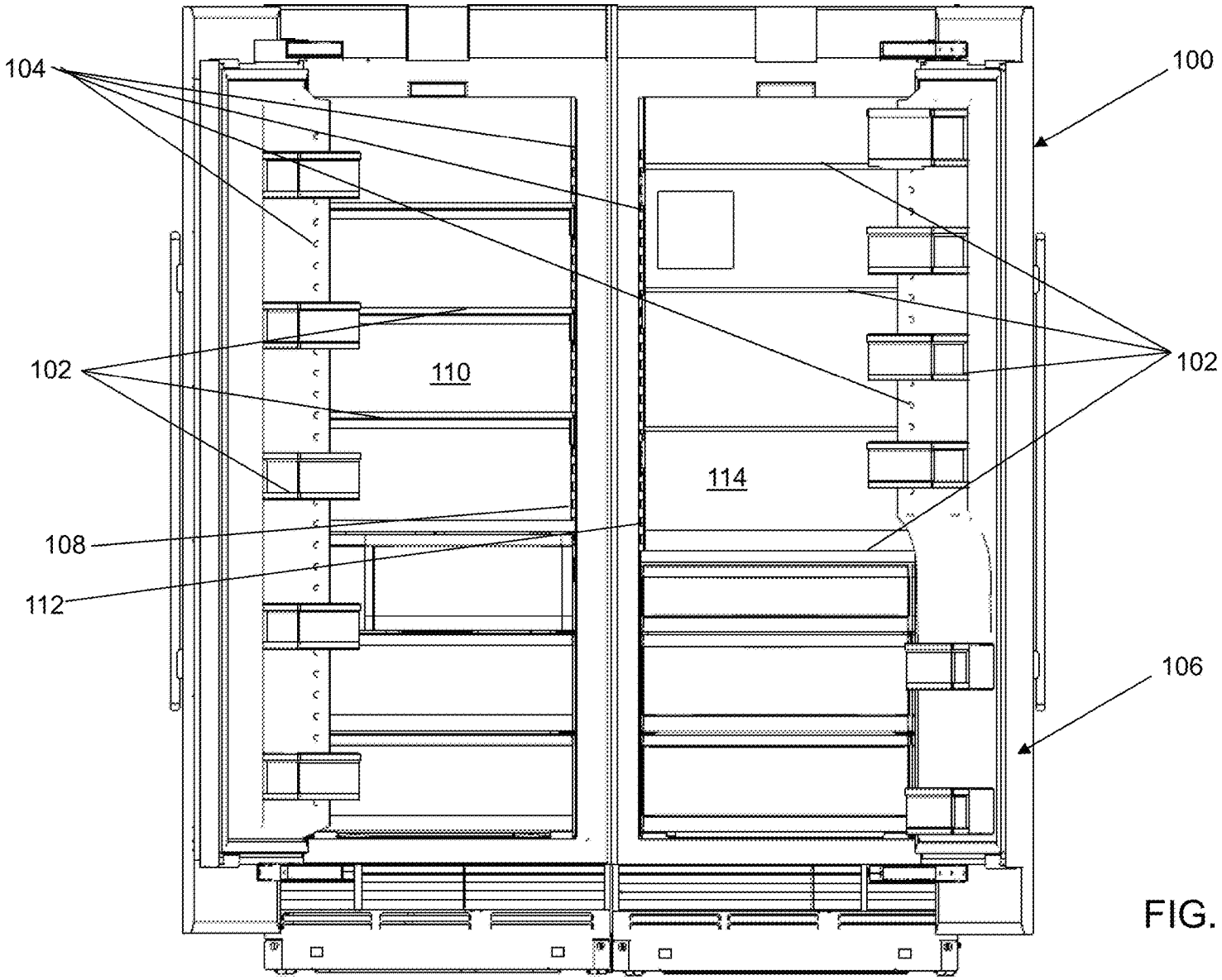
FIG. 1 depicts a device in which a plurality of shelves is mounted in accordance with an illustrative embodiment.

The connector may be connected by wire or wirelessly to a controller of a device to which the shelf is mounted such as a refrigerator 100 (shown referring to FIG. 1). One or more connectors may be associated with each shelf. For example, a first connector may provide a ground potential, a second connector may provide an alternating current/voltage or a direct current/voltage, and a third connector may provide a digital or analog data signal though a fewer or a greater number of connectors may be associated with each shelf. Power provided to the connector may be modulated, for example, using pulse width modulation to vary the amount of power, for example, to dim a light. Various voltage levels may be provided such as 12 volts (V), 24 V, etc.

Referring to FIG. 1, an illustrative device is shown in which a plurality of shelves 102 is mounted. FIG. 1 shows a front view of refrigerator 100 with open doors to show a portion of two interior spaces that include the plurality of shelves 102. The plurality of shelves 102 are mounted to a plurality of ladders 104 not all of which are visible. The plurality of ladders 104 may be mounted to one or more walls that define each interior space including a door 106 that may enclose the interior space. One or more ladders of the plurality of ladders 104 may be used to mount each shelf of the plurality of shelves 102. For example, a first left ladder (not shown) and a first right ladder 108 may be mounted to a first back wall 110 to extend vertically near a left edge and near a right edge of first back wall 110, respectively. A second left ladder 112 and a second right ladder (not shown) may be mounted to a second back wall 114 to extend vertically near a left edge and near a right edge of second back wall 114, respectively. A ladder may be mounted in other locations and to other walls that define the interior space. For example, in an alternative embodiment, the ladder may extend horizontally or in another direction. As another example, the ladder may be mounted at a center of the back wall or to a side wall. As yet another example, the ladder(s) may be mounted to door 106. A drawer or other storage space may further be mounted to the shelf. The shelf may be included in a heated or a cooled space or in a space at an ambient temperature. The cooled space, for example, may be a refrigerated space or a freezer space. One or more of the plurality of shelves 102 may extend a portion of a width and/or a depth of the interior space or an entire width and/or an entire depth of the interior space. One or more of the plurality of shelves 102 further may extend a portion of a width of door 106 or an entire width of door 106.

Figure 2:
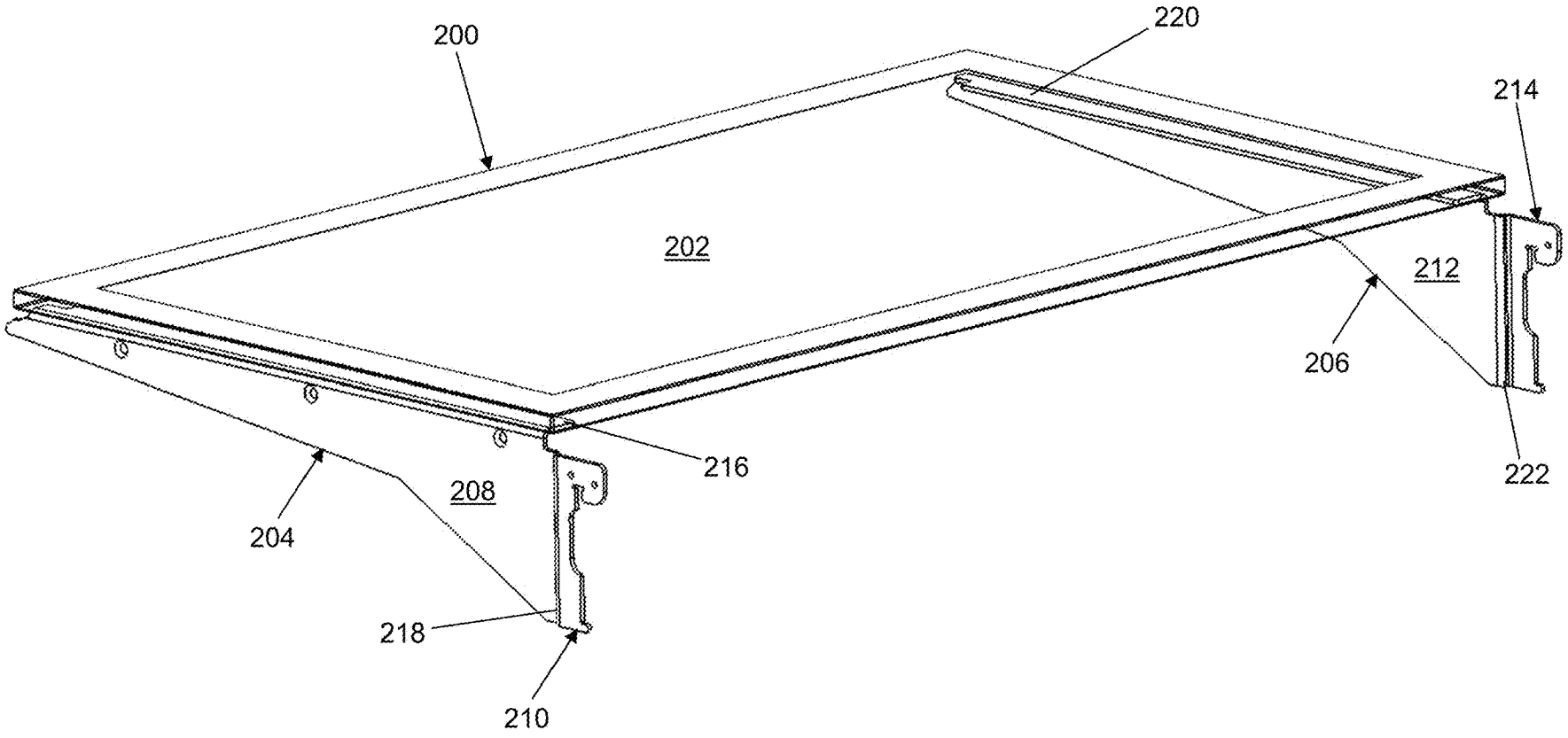
FIG. 2 depicts a back right side view of a shelf of the plurality of shelves of FIG. 1 in accordance with an illustrative embodiment.

Referring to FIG. 2, a back right side view of a shelf 200 of the plurality of shelves 102 is shown in accordance with an illustrative embodiment. Shelf 200 includes a plate 202, a right brace 204 and a left brace 206. A greater or a fewer number of braces may be used in alternative embodiments. For example, an additional brace may be included to support a larger plate 202. As another example, a single center brace may be used with a different support system such as a molded platform on either side of plate 202. Items can be placed on plate 202. The objects (not shown) connected to receive the electrical signal may be mounted anywhere on or adjacent to shelf 200 including below shelf 200 and/or to a front of shelf 200. The components of shelf 200 may be formed of one or more materials, such as metal, glass, and/or plastic having a sufficient strength and rigidity to provide the illustrated and/or described function. For example, plate 202, a drawer, or other receptacle may be formed of one or more materials, such as metal, glass, and/or plastic having a sufficient strength and rigidity to support food items or other items stored in refrigerator 100.

Plate 202 is mounted to right brace 204 and left brace 206. Plate 202 may form a variety of shapes including a polygon, a circle, etc. of various sizes. In an illustrative embodiment, plate 202 is attached to right brace 204 and to left brace 206, for example, using an adhesive though in alternative embodiments other mounting mechanisms may be used or plate 202 may not be attached to right brace 204 and left brace 206. A drawer or other receptacle may be mounted to extend upward or downward from plate 202.

Right brace 204 may include a right support arm 208 and a right bracket 210. Left brace 206 may include a left support arm 212 and a left bracket 214. Left brace 206 may form a mirror image of right brace 204 relative to a vertical plane through a center of a space between right brace 204 and left brace 206. Right support arm 208 may have various shapes and dimensions. For example, a height of right support arm 208 may narrow towards a front of shelf 200 so that less material is used and so that right support arm 208 is less visible to a consumer though the height, a width, and the material are selected to be strong enough to support a weight of items placed on plate 202. Using various openings formed in first right ladder 108 and in the first left ladder, a position of shelf 200 can be adjusted within the interior space or on door 106 or shelf 200 can be removed from the interior space or from door 106.

In the illustrative embodiment, right brace 204 may include a right curved transition wall 218 formed between right support arm 208 and right bracket 210 to assist in alignment of right bracket 210 with the ladder to which shelf 200 is mounted on a right side. Similarly, left brace 206 may include a left curved transition wall 222 formed between left support arm 212 and left bracket 214 to assist in alignment of left bracket 214 with the ladder to which shelf 200 is mounted on a left side. In an alternative embodiment, right support arm 208 and right bracket 210 and/or left support arm 212 and left bracket 214 may be formed of a continuous planar wall. Right support arm 208 and left support arm 212 may or may not extend an entire length of plate 202.

In the illustrative embodiment, right brace 204 further may include a right support wall 216 that extends horizontally at an approximately 90-degree angle from a top edge of right support arm 208 away from the wall forming the interior space when right brace 204 is mounted in the interior space. Similarly, left brace 206 further may include a left support wall 220 that extends horizontally at an approximately 90-degree angle from a top edge of left support arm 212 away from the wall forming the interior space when left brace 206 is mounted in the interior space. Plate 202 is positioned to abut and rest on right support wall 216 and left support wall 220. Right support wall 216 and/or left support wall 220 may extend horizontally in either or both directions from the top edge of a respective brace to provide a stable platform for plate 202. Though not shown, a brace need not be mounted adjacent a wall that forms the interior space. Instead, the brace may be mounted, for example, to first back wall 110 between the side walls that form the interior space as an additional support for plate 202 that extends between the side walls or to provide support for plate 202 that does not extend an entire width between the side walls.

Figure 3:
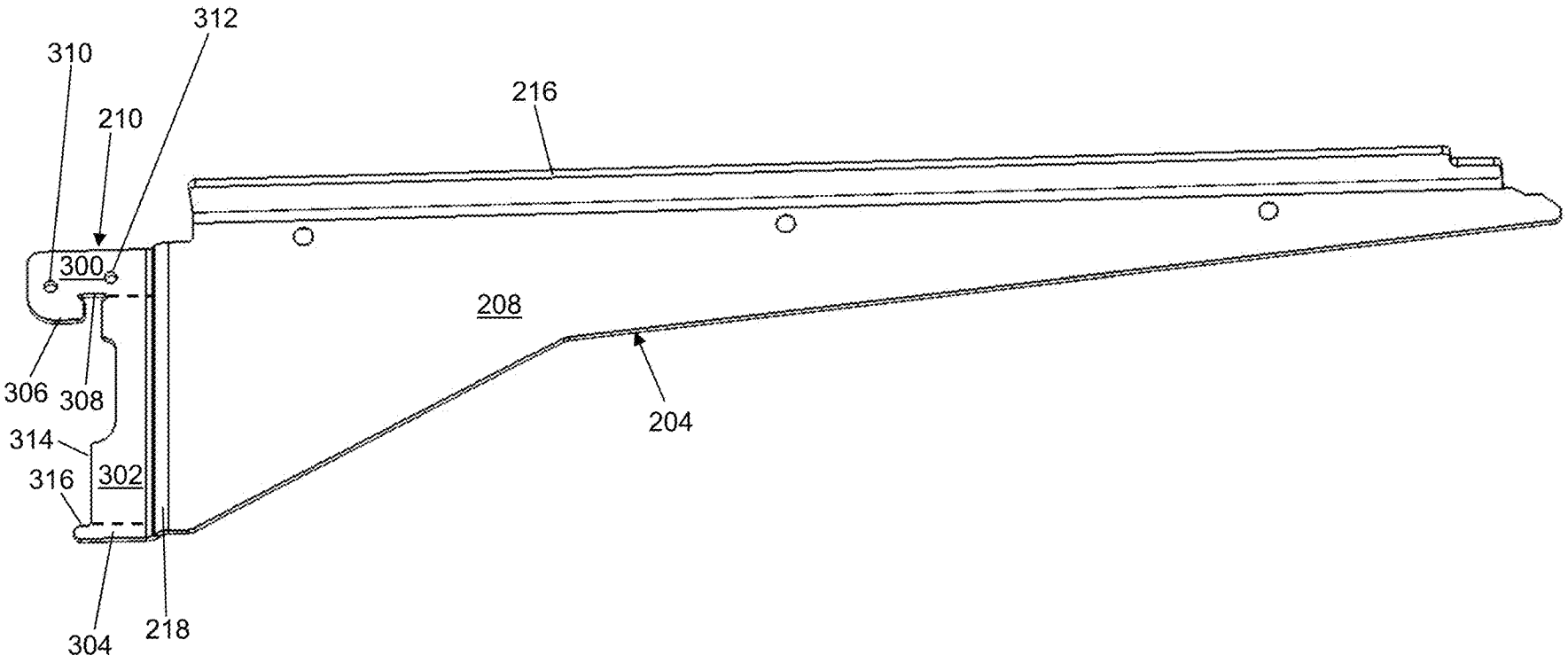
FIG. 3 depicts a left side view of a right brace of the shelf of FIG. 2 in accordance with an illustrative embodiment.
Figure 4:
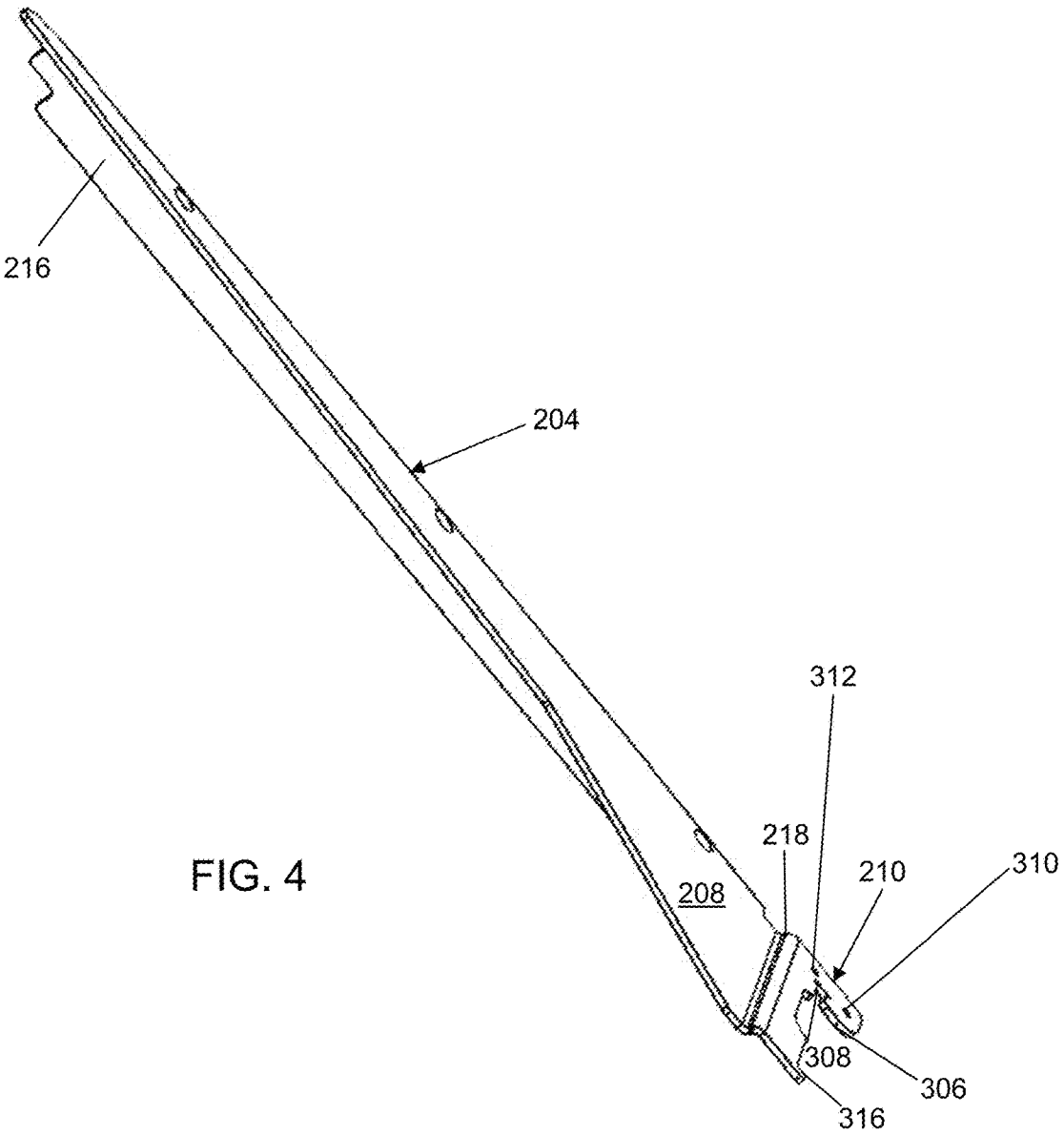
FIG. 4 depicts a bottom, right side view of the right brace of FIG. 3 in accordance with an illustrative embodiment.

Referring to FIG. 3, a left side view of right brace 204 is shown in accordance with an illustrative embodiment. Referring to FIG. 4, a bottom, left side view of right brace 204 is shown in accordance with an illustrative embodiment. Right bracket 210 and left bracket 214 may be identical. Though right bracket 210 and left bracket 214 may be formed of a single piece of material, a shape of right bracket 210 and of left bracket 214 can be described as including a head portion 300, a body portion 302, and a foot portion 304 with dashed lines showing approximate boundaries between the shape elements though the boundaries are merely to facilitate a description of a shape of right bracket 210 and of left bracket 214. Right bracket 210 and left bracket 214 are used to mount shelf 200 to a ladder such as first right ladder 108 or the first left ladder, respectively, by partially inserting head portion 300 and foot portion 304 into one or more apertures formed in first right ladder 108 and the first left ladder.

Head portion 300 has a hook or downward facing L-shape that extends from right curved transition wall 218 and includes a hook head contact surface 306, a ladder mounting surface 308, a first fastener aperture wall 310, and a second fastener aperture wall 312. Body portion 302 extends from right curved transition wall 218 and includes a body surface 314 opposite right curved transition wall 218 that may abut a front surface of the ladder to which shelf 200 is mounted using right bracket 210 and/or left bracket 214. Foot portion 304 extends from right curved transition wall 218 and includes a foot contact surface 316 opposite right curved transition wall 218 that extends outward from body surface 314.

Figure 5:
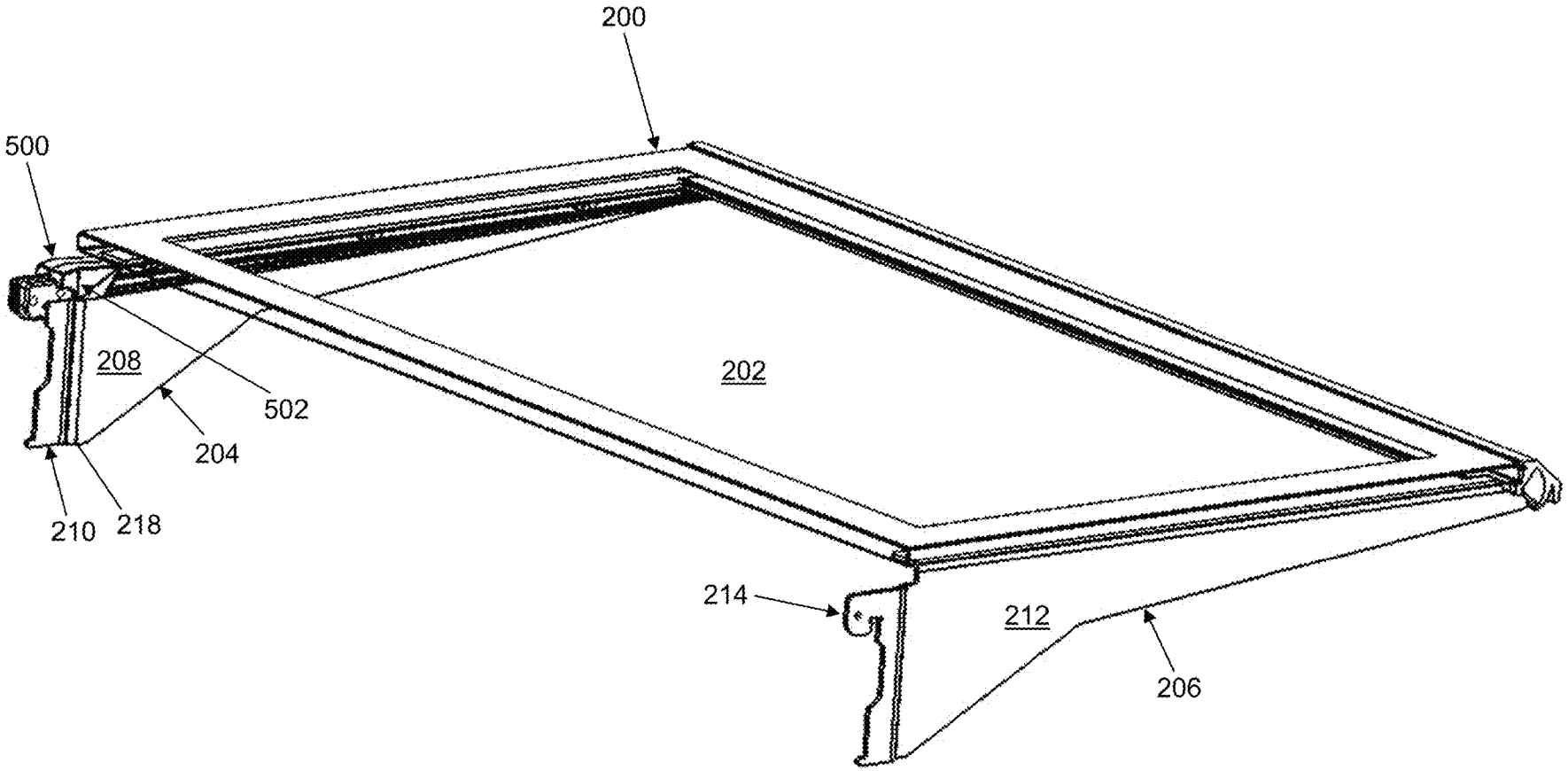
FIG. 5 depicts a back left side view of the shelf of FIG. 2 in accordance with an illustrative embodiment.
Figure 6:
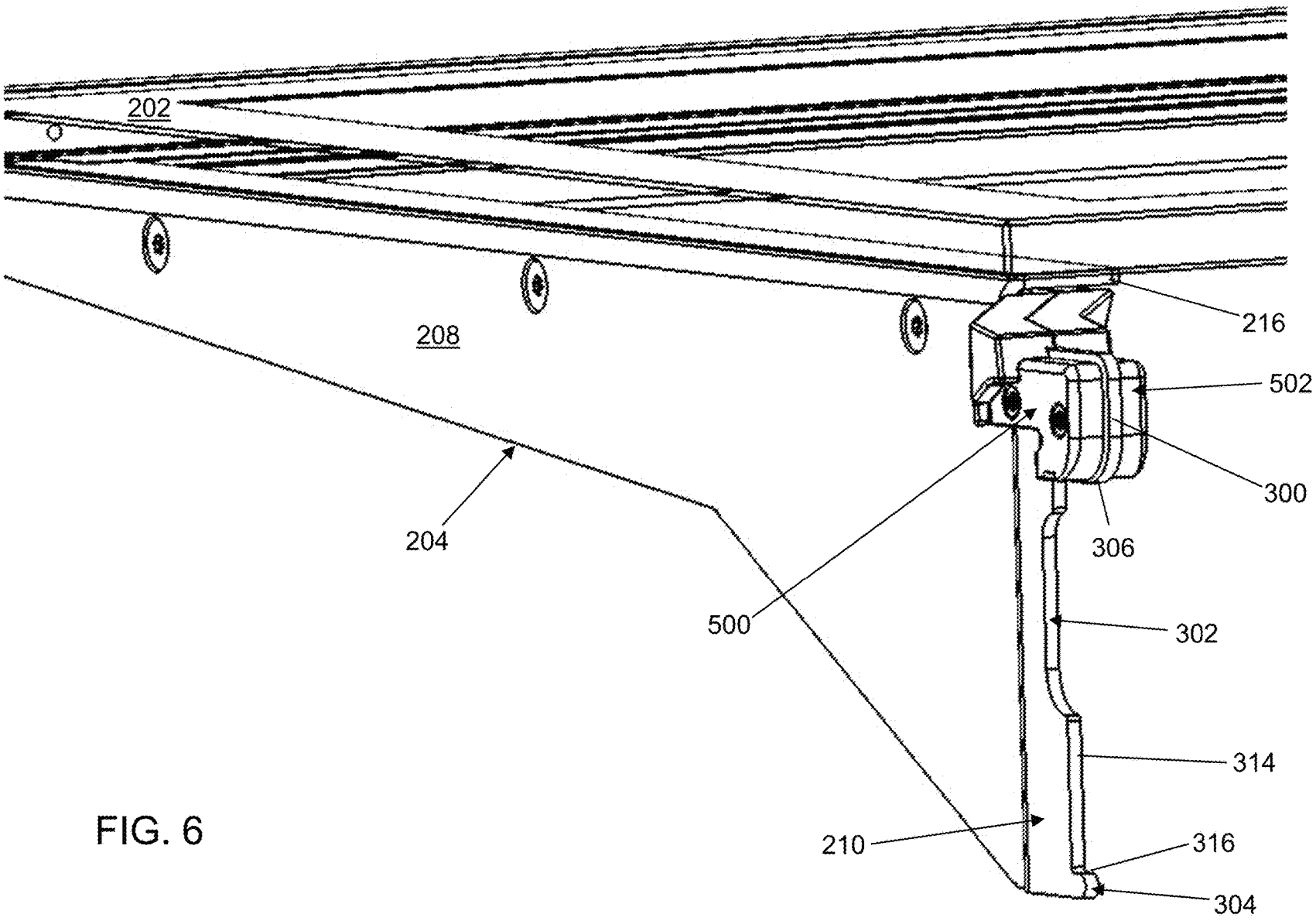
FIG. 6 depicts a back right side view of a first shelf connector and a second shelf connector mounted to a right bracket of the right brace of FIG. 3 in accordance with an illustrative embodiment.

Referring to FIG. 5, a back left side view of shelf 200 is shown in accordance with an illustrative embodiment. Referring to FIG. 6, a back right side view of right brace 204 is shown in accordance with an illustrative embodiment. A first shelf connector 500 and a second shelf connector 502 are mounted on opposite sides of head portion 300 of right bracket 210 and a top edge of curved transition wall 300 though first shelf connector 500 and second shelf connector 502 may be mounted to the same side of head portion 300 of right bracket 210 in an alternative embodiment.

In the illustrative embodiment of FIG. 5, two shelf connectors are mounted to right bracket 210 and no shelf connector is mounted to left bracket 214. In alternative embodiments, zero or more shelf connectors may be mounted to each bracket of shelf 200 of each shelf of the plurality of shelves 102. For example, some shelves of the plurality of shelves 102 may not include an object for which an electrical signal is useable. As a result, the bracket(s) used to mount the shelf to the ladder may not include any shelf connector while others may include one or more shelf connectors.

Figure 7:
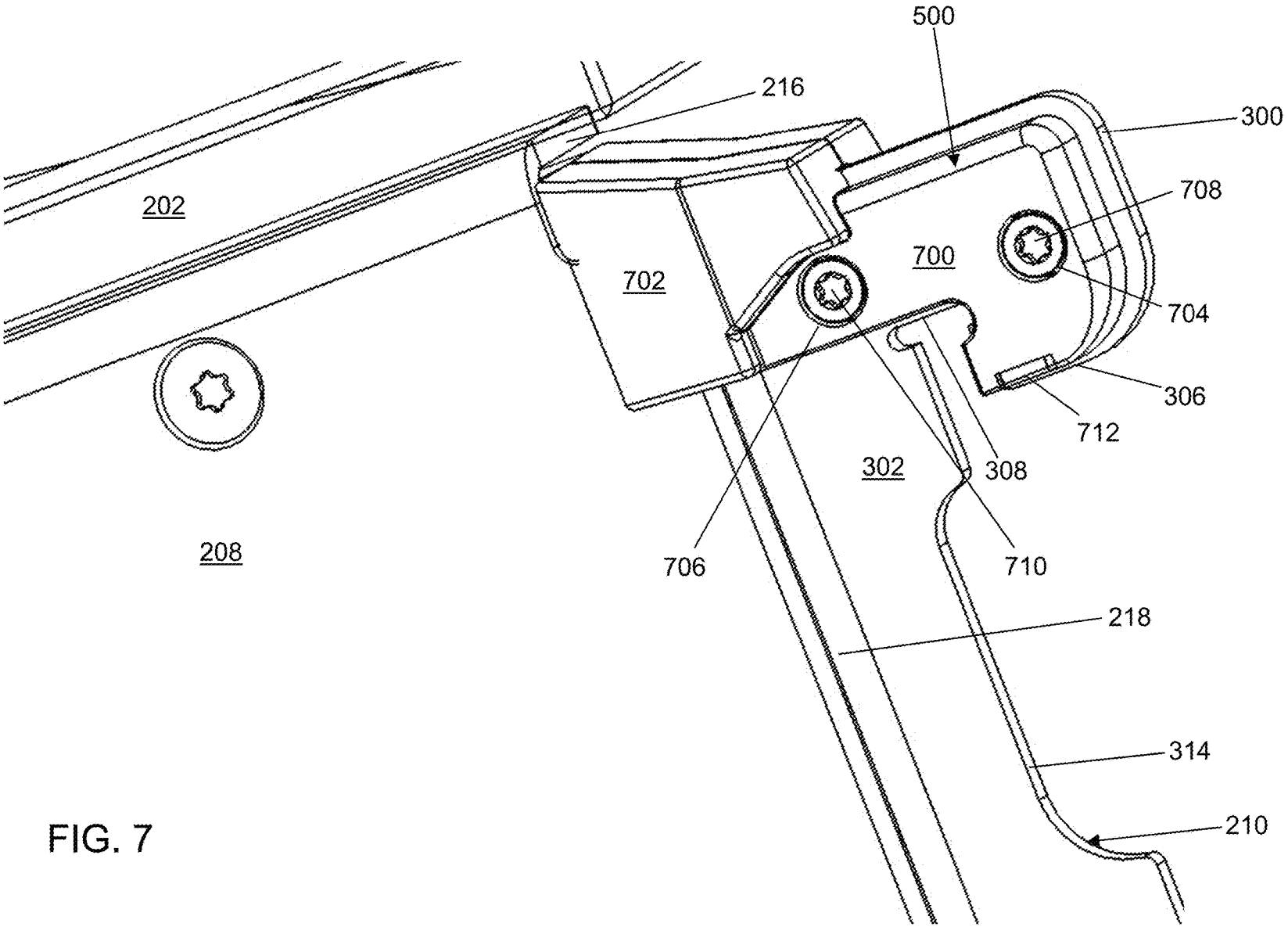
FIG. 7 depicts a back right side view of the first shelf connector of FIG. 6 mounted to the right bracket of the right brace of FIG. 3 in accordance with an illustrative embodiment.
Figure 8:
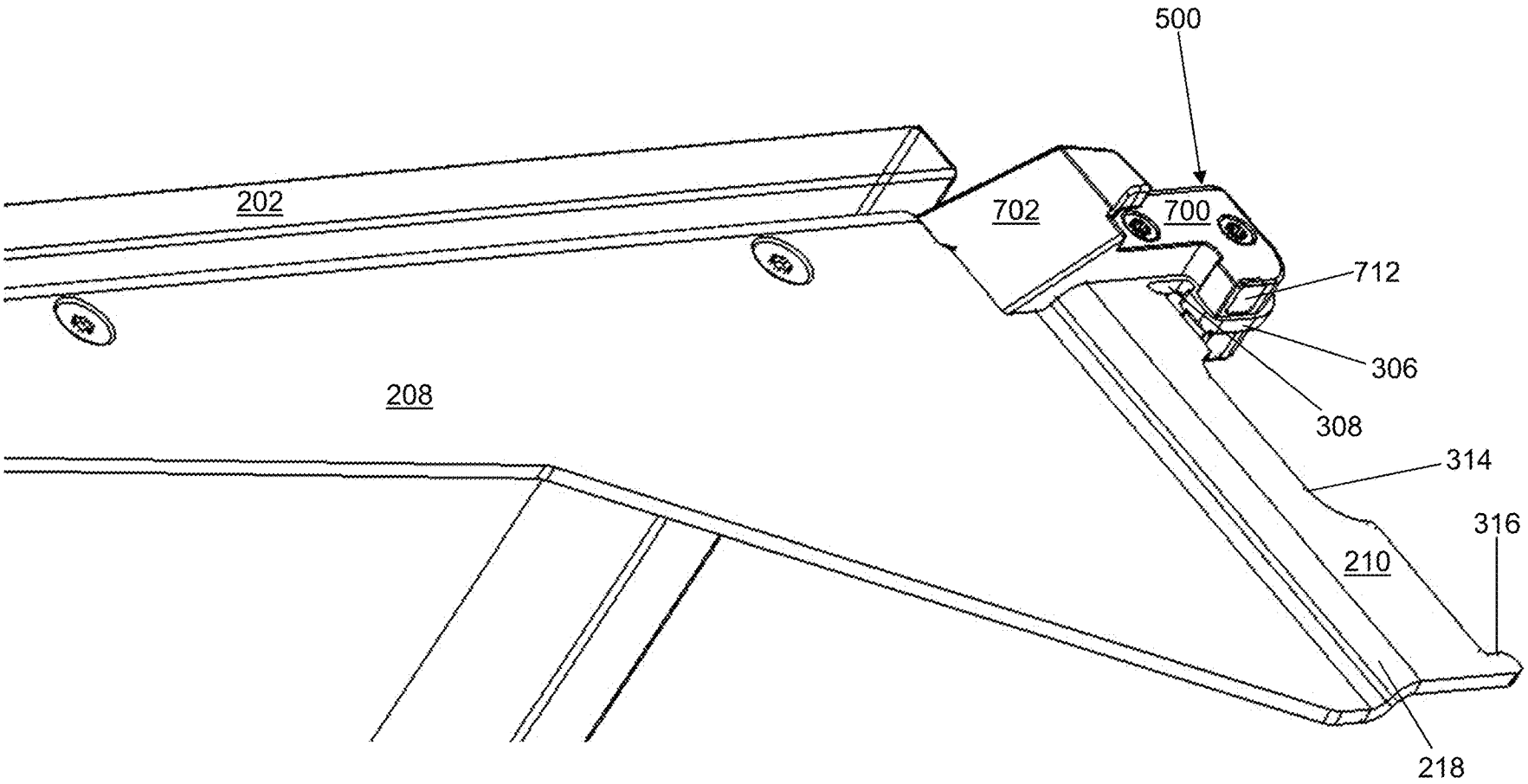
FIG. 8 depicts a bottom right side view of the first shelf connector of FIG. 6 mounted to the right bracket of the right brace of FIG. 3 in accordance with an illustrative embodiment.
Figure 9:
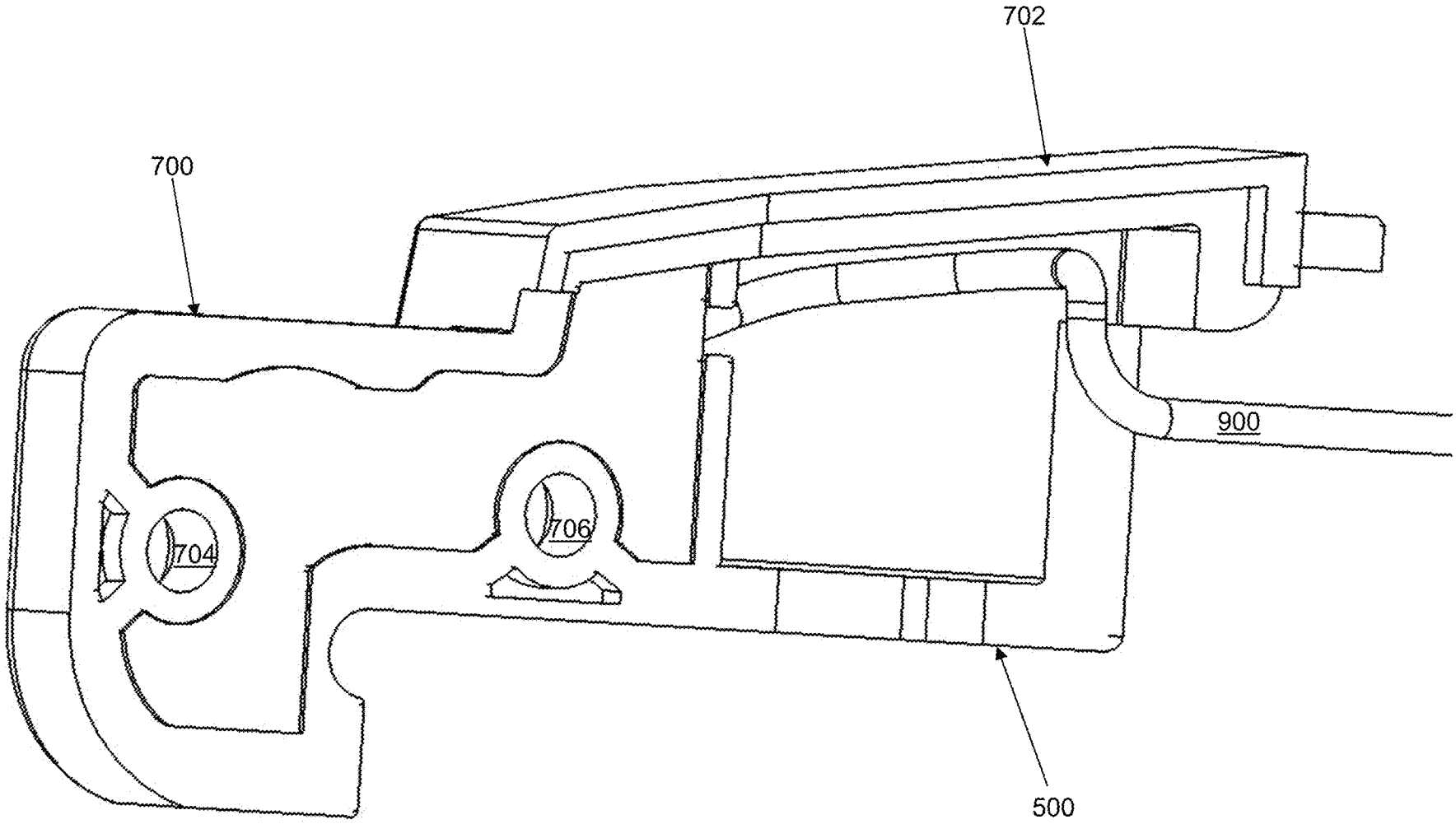
FIG. 9 depicts a left side view of the first shelf connector of FIG. 6 is shown in accordance with an illustrative embodiment.

Referring to FIG. 7, a back right side view of first shelf connector 500 mounted to right bracket 210 is shown in accordance with an illustrative embodiment. Referring to FIG. 8, a bottom right side view of first shelf connector 500 mounted to right bracket 210 is shown in accordance with an illustrative embodiment. Referring to FIG. 9, a left side view of first shelf connector 500 is shown in accordance with an illustrative embodiment. Though first shelf connector 500 and second shelf connector 502 may be formed of a single piece of material, a shape of first shelf connector 500 can be described as including a connection housing 700, a wire cover 702, a third fastener aperture wall 704, a fourth fastener aperture wall 706, and a contact pad 712. Connection housing 700 may have a similar shape to head portion 300 of right bracket 210. In the illustrative embodiment, wire cover 702 may have a curved shape similar to curved transition wall 218 and mount to cover a top portion of curved transition wall 218 and of right support arm 208 to abut right support wall 216. In an alternative embodiment, wire cover 702 may not be included and/or connection housing need not have a similar shape as head portion 300 of right bracket 210. First shelf connector 500 and second shelf connector 502 further may include a greater or a fewer fastener aperture walls.

A wire 900 may extend from connection housing 700 below wire cover 702. In the illustrative embodiment, wire 900 extends to a front edge of plate 202 of shelf 200 though wire 900 can extend to any location on, in, or adjacent to shelf 200. Wire 900 may be an insulated wire made of various conductive materials and gauge sizes based on the object(s) connected to receive the electric signal.

Figure 10:
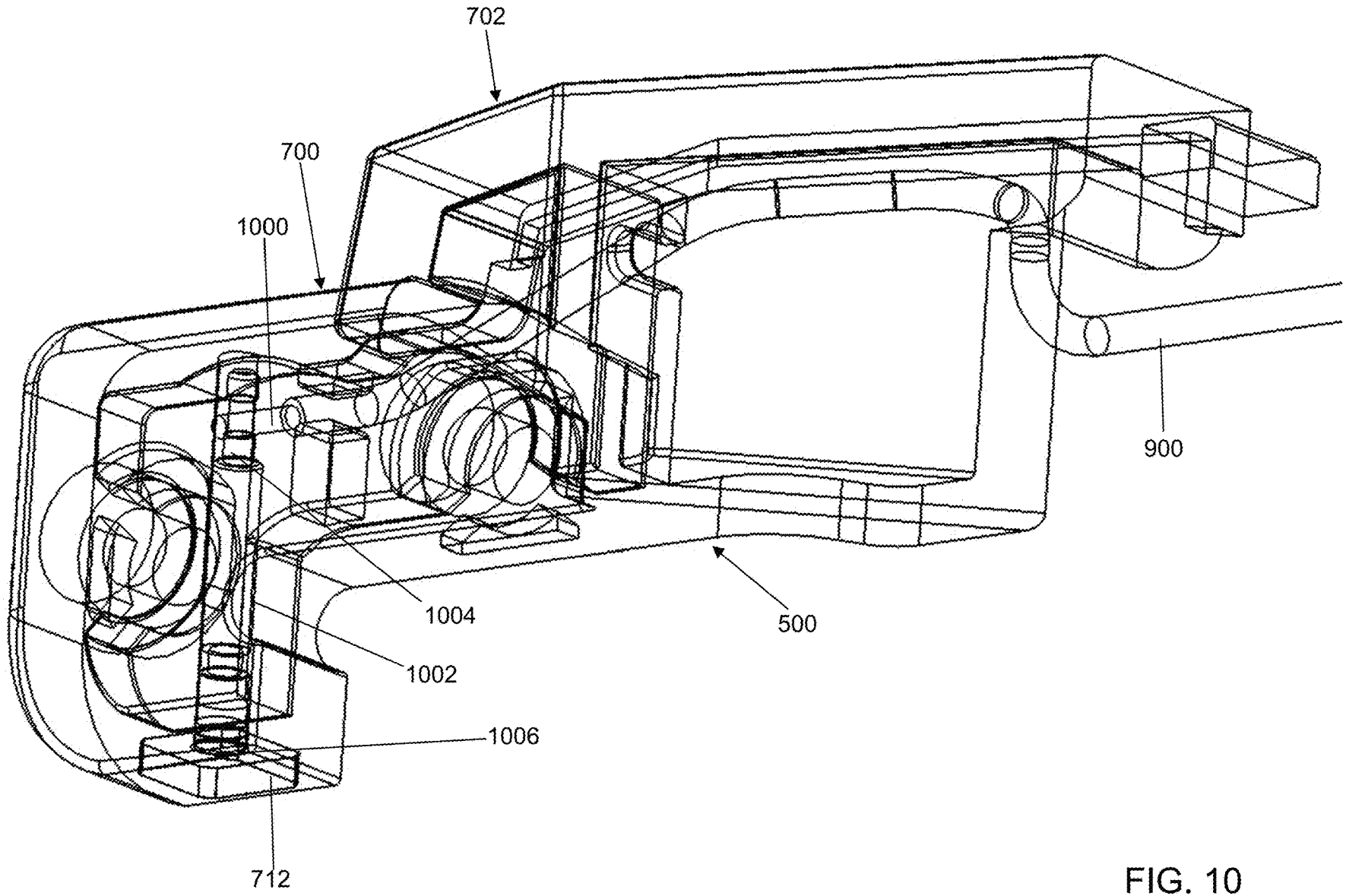
FIG. 10 depicts a left side transparent view the first shelf connector of FIG. 6 in accordance with an illustrative embodiment.

Referring to FIG. 10, a left side transparent view of first shelf connector 500 is shown in accordance with an illustrative embodiment. Wire 900 is electrically connected at a first end 1000 to a second internal wire 1002. Second internal wire 1002 is mounted within first shelf connector 500 and is electrically connected at a first end 1004 to first end 1000 of wire 900 and at a second end 1006 to contact pad 712. Second internal wire 1002 may be an insulated wire made of various conductive materials and gauge sizes. In an alternative embodiment, a solid conductor component may replace second internal wire 1002 to electrically connect first end 1000 of wire 900 to contact pad 712. First end 1000 of wire 900 further may contact second internal wire 1002 at other locations within or adjacent to first shelf connector 500. For example the solid conductor component may electrically contact wire 900 external to first shelf connector 500. Contact pad 712 is mounted horizontally to a lower edge of a hook formed by connection housing 700 and provides an electrical contact point for the electrical signal provided to/from shelf 200.

When first shelf connector 500 is mounted to right bracket 210, a first fastener 708 is inserted into third fastener aperture wall 704 and into first fastener aperture wall 310, which are aligned. Similarly, a second fastener 710 is inserted into fourth fastener aperture wall 706 and into second fastener aperture wall 312, which are aligned. Other mounting mechanisms as well as various fasteners, such as screws or rivets, may be used to mount first shelf connector 500 to right bracket 210. Head portion 300 of right bracket 210 covers a left side of connection housing 700 of first shelf connector 500. In the illustrative embodiment, wire 900 is curved adjacent curved transition wall 218 and extends beneath support wall 216 so that wire 900 is not readily visible and not easily snagged on items stored on or around shelf 200.

The components of first shelf connector 500 may be formed of one or more materials, such as metal, glass, and/or plastic having a sufficient strength and rigidity to provide the illustrated and/or described function. For example, connection housing 700 and wire cover 702 may be formed of a single continuous piece of insulating material using a molding process. Contact pad 712 may be formed of an electrically conductive material that is sized and shaped based on an electrical contact to which contact pad 712 is joined when shelf 200 is mounted to the ladder.

Figure 11:
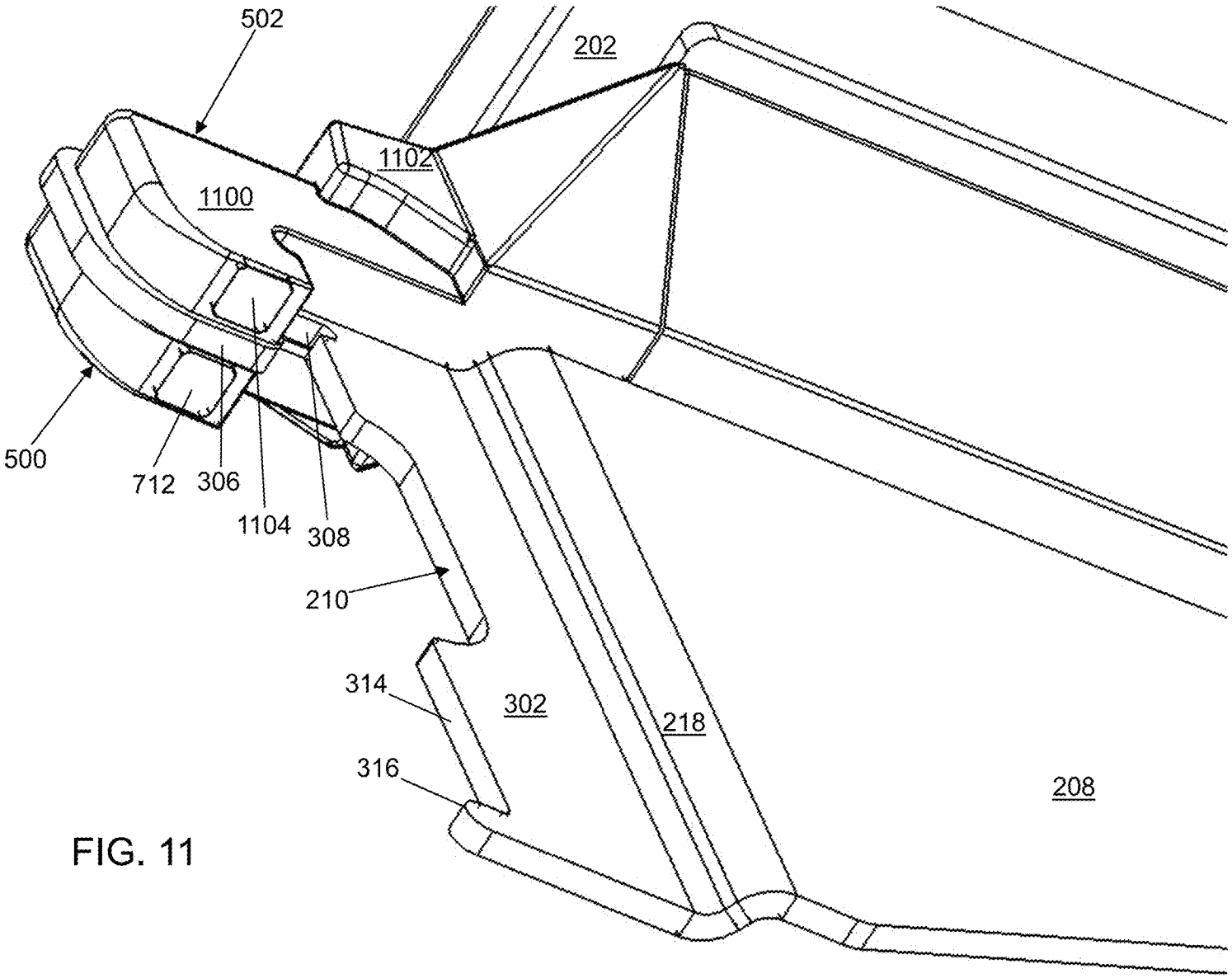
FIG. 11 depicts a bottom left side view of the first shelf connector and the second shelf connector of FIG. 6 mounted to the right bracket of the right brace of FIG. 3 in accordance with an illustrative embodiment.
Figure 12:
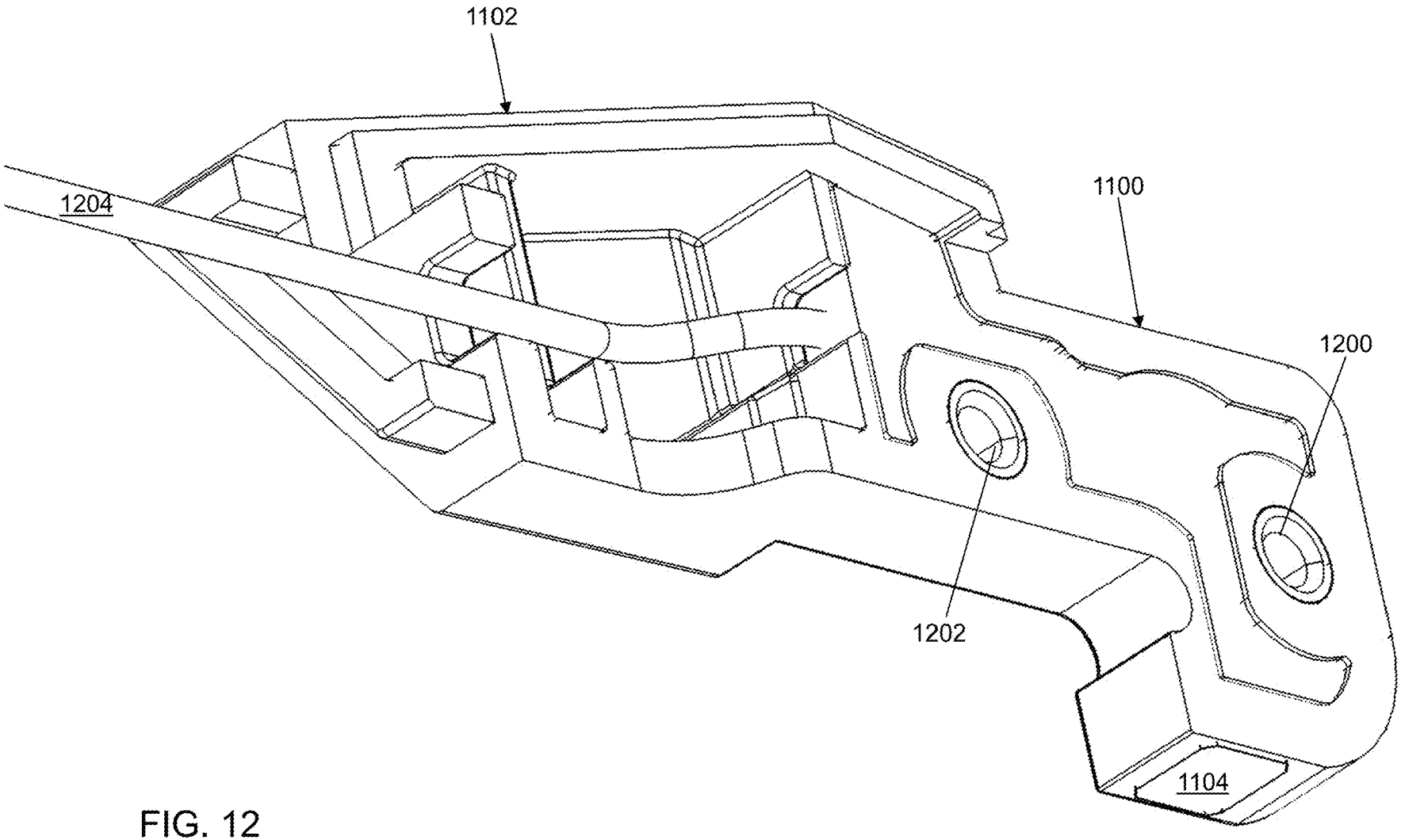
FIG. 12 depicts a bottom right side view of the second shelf connector of FIG. 6 in accordance with an illustrative embodiment.

Referring to FIG. 11, a bottom left side view of first shelf connector 500 and of second shelf connector 502 mounted to right bracket 210 is shown in accordance with an illustrative embodiment. Referring to FIG. 12, a bottom right side view of second shelf connector 502 is shown in accordance with an illustrative embodiment. Similar to first shelf connector 500, second shelf connector 502 may include a second connection housing 1100, a second wire cover 1102, a fifth fastener aperture wall 1200, a sixth fastener aperture wall 1202, and a second contact pad 1104.

A second wire 1204 may extend from second connection housing 1100 below second wire cover 1102. In the illustrative embodiment, second wire 1204 extends to the front edge of plate 202 of shelf 200 though second wire 1204 can extend to any location on, in, or adjacent to shelf 200. Similar to wire 900, second wire 1204 is electrically connected at a first end (not shown) to second contact pad 1104 that is mounted horizontally to a lower edge of a hook formed by second connection housing 1100. Second contact pad 1104 provides a second electrical contact point for a second electrical signal provided to/from shelf 200. In an illustrative embodiment, second wire 1204 and wire 900 provide power to a device to which second wire 1204 and wire 900 are connected at second ends opposite the first ends. For example, one of wire 900 and second wire 1204 may provide a ground potential while the other provides a positive voltage/current. In alternative embodiments, either or both of wire 900 and second wire 1204 may provide a data signal.

When second shelf connector 502 is mounted to right bracket 210, first fastener 708 is inserted into third fastener aperture wall 704 (when first shelf connector 500 is also mounted to right bracket 210), into first fastener aperture wall 310, and into fifth fastener aperture wall 1200, which are aligned. Similarly, second fastener 710 is inserted into fourth fastener aperture wall 706, into second fastener aperture wall 312, and into sixth fastener aperture wall 1202, which are aligned. In the illustrative embodiment, second wire 1204 is curved adjacent curved transition wall 218 and extends beneath support wall 216 so that second wire 1204 is not readily visible and not easily snagged on items stored on or around shelf 200. In the illustrative embodiment, hook head contact surface 306 of right bracket 210 is positioned between contact pad 712 of first shelf connector 500 and second contact pad 1104 of second shelf connector 502 when both first shelf connector 500 and second shelf connector 502 are mounted to right bracket 210.

Figure 13:
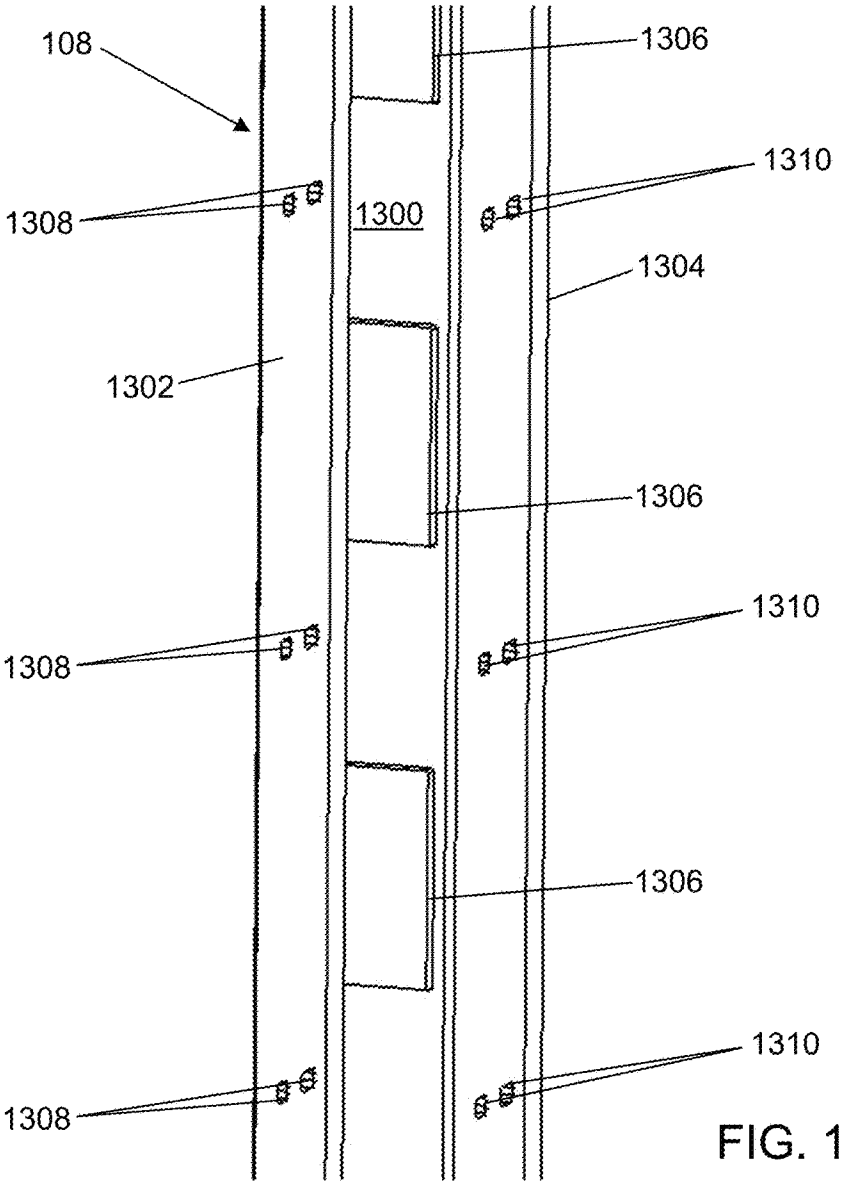
FIG. 13 depicts a zoomed back perspective view of a ladder in accordance with an illustrative embodiment.

Referring to FIG. 13, a zoomed back perspective view of first right ladder 108 is shown in accordance with an illustrative embodiment. Each ladder of the plurality of ladders 104 may be similar. First right ladder 108 may include a front wall 1300, a right side wall 1302, and a left side wall 1304 mounted to each other to form a u-shaped brace. Front wall 1300 includes a plurality of shelf bracket aperture walls 1306 that define spaced apart apertures formed through front wall 1300 at regular intervals to provide a plurality of mounting locations for shelf 200 of the plurality of shelves 102. Right side wall 1302 includes a plurality of pairs of right ladder connector aperture walls 1308 that define spaced apart apertures formed through right side wall 1302 at regular intervals to provide a plurality of mounting locations for a ladder connector 1500 (shown referring to FIG. 15). Left side wall 1304 includes a plurality of pairs of left ladder connector aperture walls 1310 that define spaced apart apertures formed through left side wall 1304 at regular intervals to provide the plurality of mounting locations for ladder connector 1500. For example, a pair of right ladder connector aperture walls 1308 align horizontally at a common vertical height with a pair of left ladder connector aperture walls 1310 so that ladder connector 1500 is supported on both sides.

First right ladder 108 may be formed of one or more materials, such as metal, glass, and/or plastic having a sufficient strength and rigidity to provide the illustrated and/or described function of supporting one or more of the plurality of shelves 102. First right ladder 108 may be formed of a single continuous piece of material.

A number of shelf bracket aperture walls 1306 spaced in the vertical direction may be selected to define a number of optional mounting locations for shelf 200. In the illustrative embodiment, a distance between a lower edge of a first shelf bracket aperture wall and an upper edge of a second shelf bracket aperture wall is defined based on a geometry of right bracket 210. In the illustrative embodiment, the shelf bracket aperture walls 1306 are generally rectangular in shape and sized to allow insertion therein of head portion 300 of right bracket 210 with or without zero or more shelf connectors such as first shelf connector 500 and second shelf connector 502.

When right bracket 210 is mounted to first right ladder 108, head portion 300 of right bracket 210 is inserted through the first shelf bracket aperture wall of shelf bracket aperture walls 1306 of first right ladder 108 based on a desired height of shelf 200, and foot portion 306 of right bracket 210 is inserted through the second shelf bracket aperture wall of shelf bracket aperture walls 1306 of first right ladder 108 that is below the first shelf bracket aperture wall. The second shelf bracket aperture wall of shelf bracket aperture walls 1306 may or may not be a next shelf bracket aperture wall immediately below the first shelf bracket aperture wall. Similarly, when left bracket 214 is mounted to the first left ladder, head portion 300 of left bracket 214 is inserted through a shelf bracket aperture wall of shelf bracket aperture walls 1306 of the first left ladder, and foot portion 306 of left bracket 214 is inserted through the second shelf bracket aperture wall of shelf bracket aperture walls 1306 of the first left ladder that is below the first shelf bracket aperture wall so that plate 202 of shelf 200 provides a horizontal surface on which items can be placed.

Figure 24:
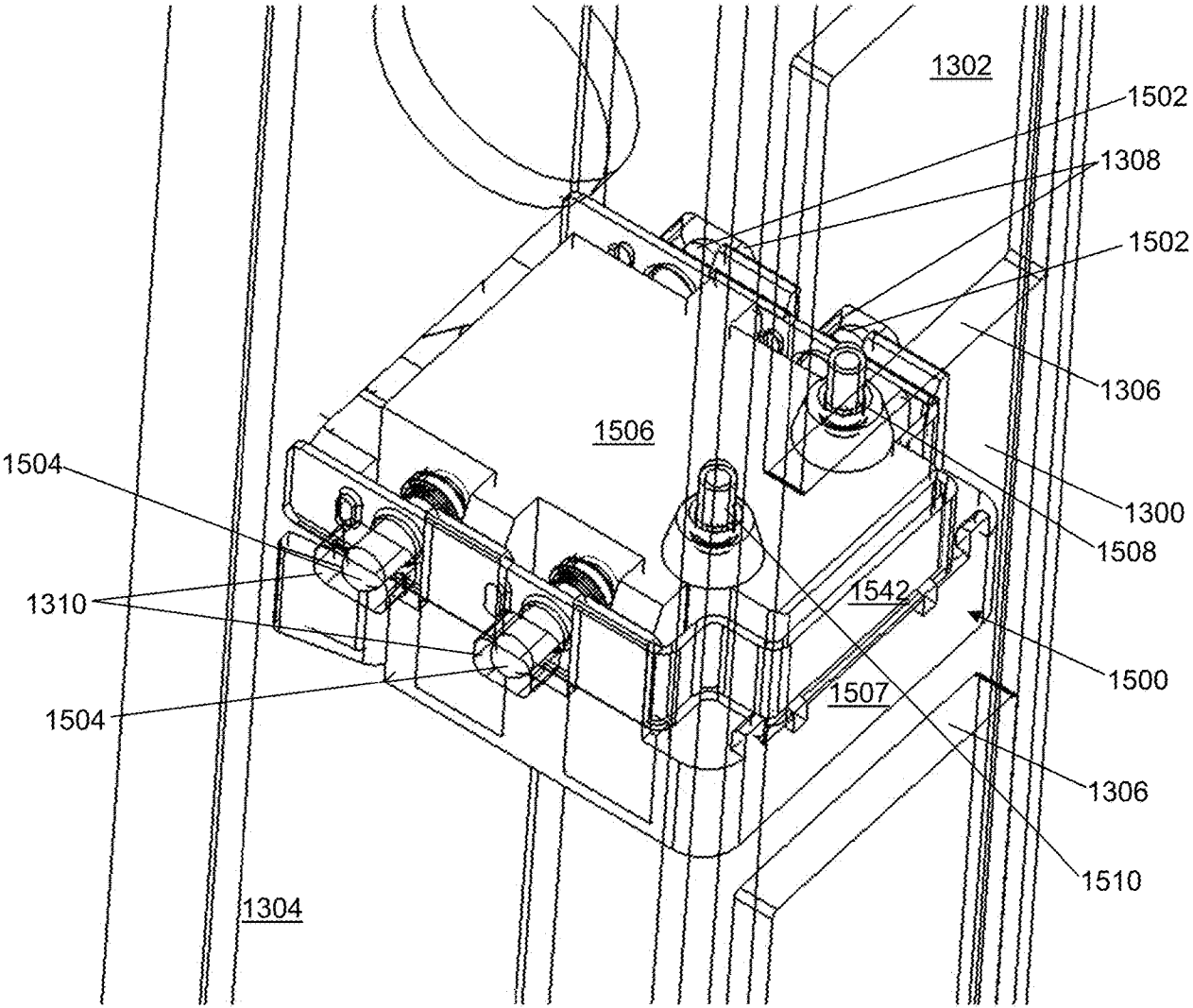
FIG. 24 depicts a front, top left perspective view of the ladder connector of FIG. 15 mounted to the ladder of FIG. 13 with the ladder transparent in accordance with an illustrative embodiment in the dismounted position.

In the illustrative embodiment, each pair of right ladder connector aperture walls 1308 are oblong in shape and sized to accommodate a right mounting pin of right mounting pins 1502 (shown referring to FIG. 15) therein as illustrated in FIG. 24 while also allowing a tolerance in a position of the right mounting pin in a horizontal plane through a center of each pair of right ladder connector aperture walls 1308. Similarly, the left ladder connector aperture walls 1310 are oblong in shape and sized to accommodate a left mounting pin of left mounting pins 1504 (shown referring to FIG. 15) therein while also allowing a tolerance in a position of the left mounting pin in a horizontal plane through a center of the left ladder connector aperture walls 1310. A spacing in a vertical direction between a center of successive pairs of the right ladder connector aperture walls 1308 and between a center of successive pairs of the left ladder connector aperture walls 1310 and between a center of successive shelf bracket aperture walls 1306 may be the same to align right mounting pins 1502 and left mounting pins 1504 with right bracket 210.

Figure 14:
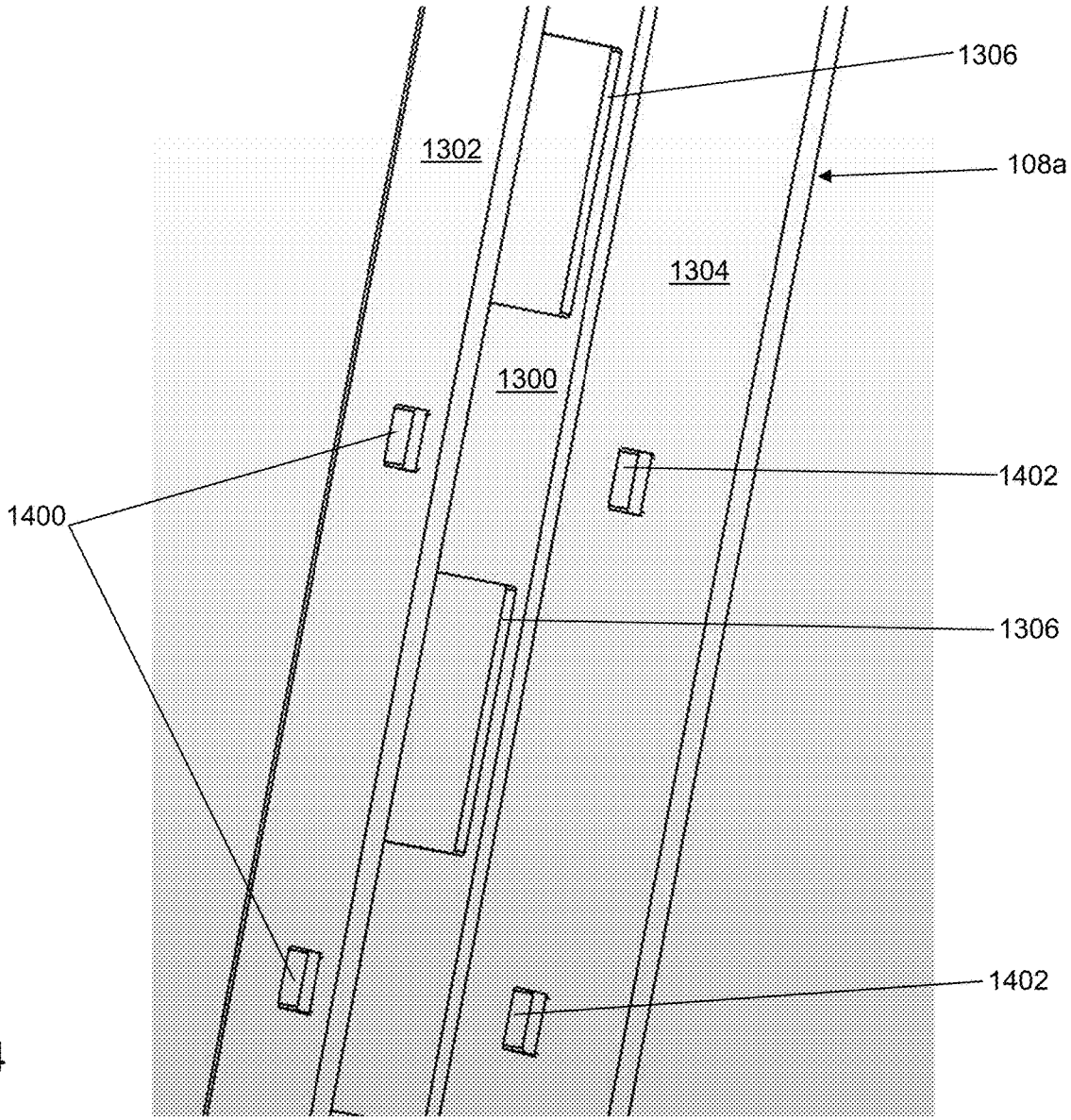
FIG. 14 depicts a zoomed back perspective view of a second ladder in accordance with an illustrative embodiment.

A fewer or a greater number of right mounting pins 1502 and left mounting pins 1504 may be used in alternative embodiments. For example, referring to FIG. 14, a zoomed back perspective view of a second right ladder 108*a* that is similar to first right ladder 108 is shown in accordance with another illustrative embodiment. Second right ladder 108*a* may include front wall 1300, right side wall 1302, and left side wall 1304 mounted to each other to form the u-shaped brace. Right side wall 1302 includes a plurality of right ladder connector aperture walls 1400 that define spaced apart apertures formed through right side wall 1302 at regular intervals to provide a plurality of mounting locations for a second ladder connector 1600 (shown referring to FIG. 16). Left side wall 1304 includes a plurality of left ladder connector aperture walls 1402 that define spaced apart apertures formed through left side wall 1304 at regular intervals to provide the plurality of mounting locations for second ladder connector 1600. For example, a right ladder connector aperture wall aligns horizontally at a common vertical height with a left ladder connector aperture wall so that second ladder connector 1600 is supported on both sides.

Figure 15:
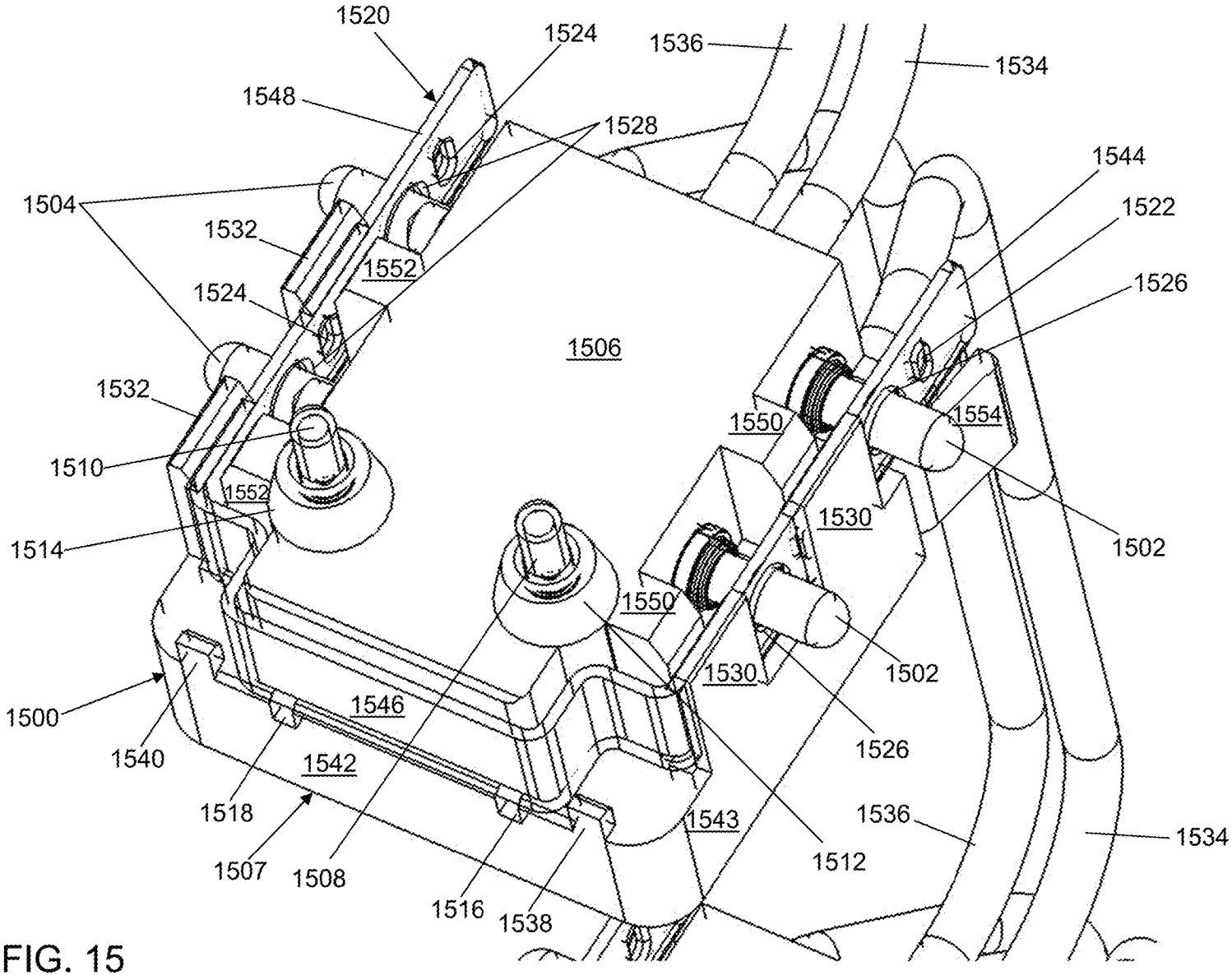
FIG. 15 depicts a front top perspective view of a ladder connector in accordance with an illustrative embodiment in a mounted position.
Figure 17:
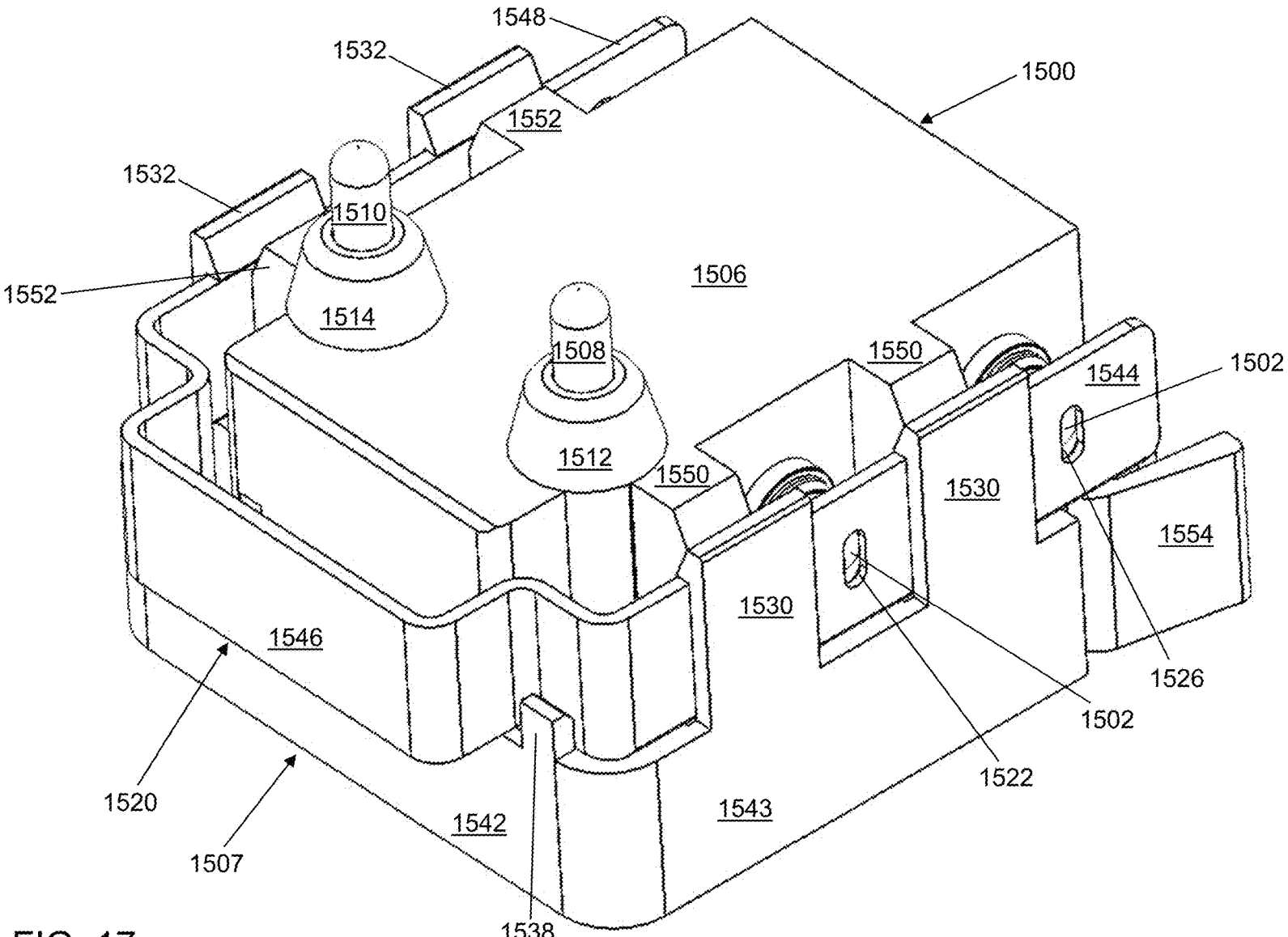
FIG. 17 depicts a top right perspective view of the ladder connector of FIG. 15 in accordance with an illustrative embodiment in a dismounted position.
Figure 18:
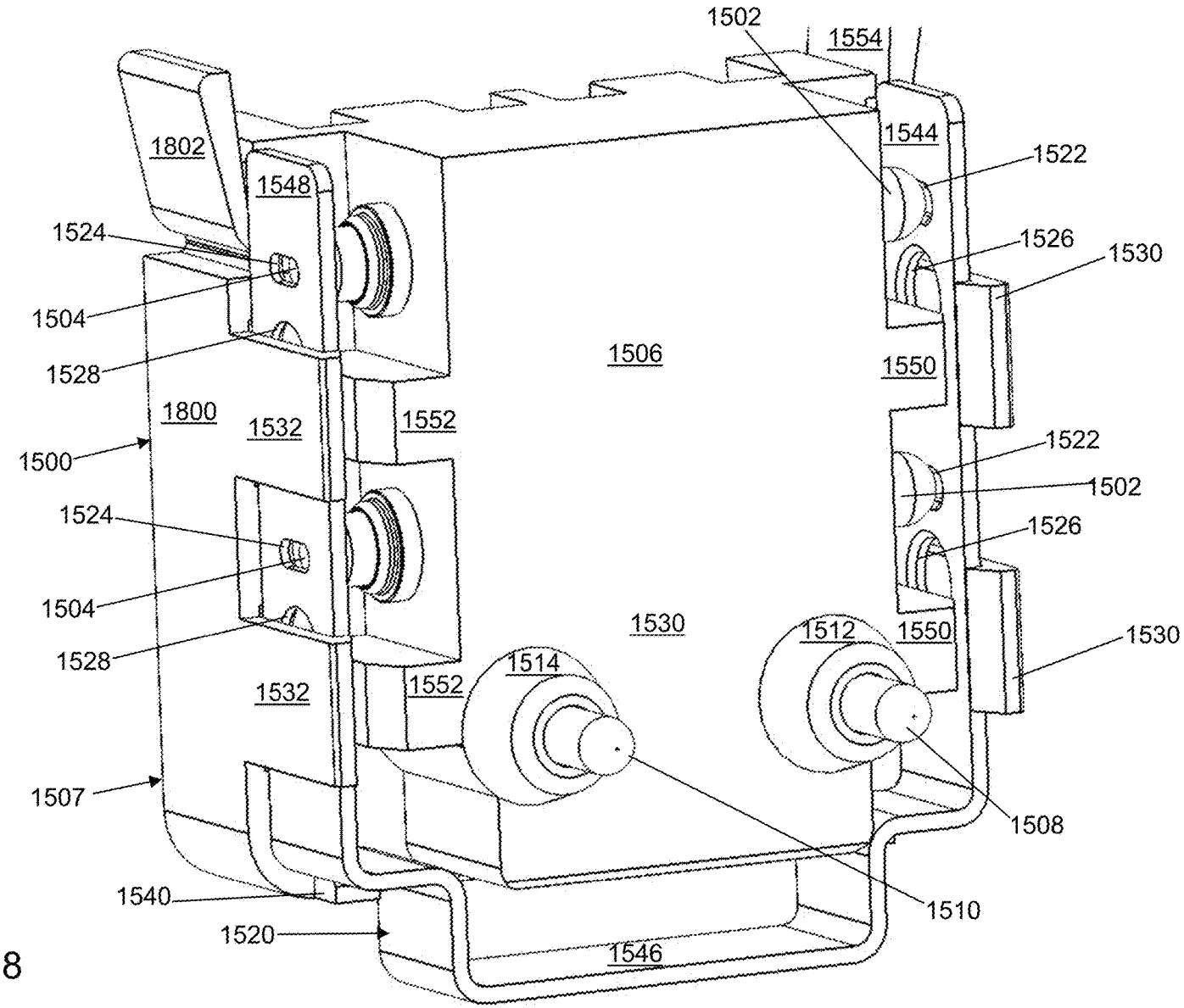
FIG. 18 depicts a top left perspective view of the ladder connector of FIG. 15 in accordance with an illustrative embodiment in the dismounted position.
Figure 19:
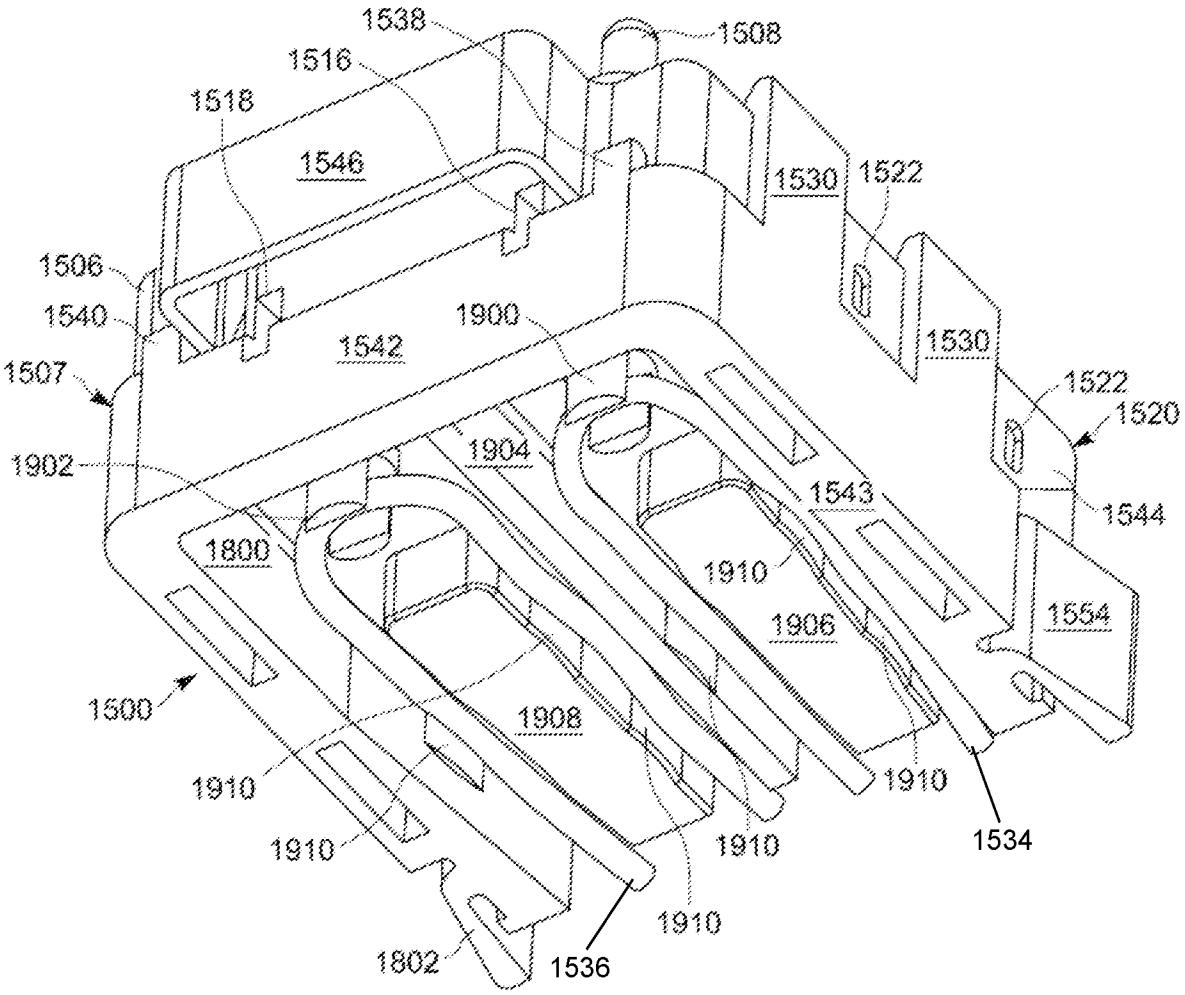
FIG. 19 depicts a front bottom perspective view of the ladder connector of FIG. 15 in accordance with an illustrative embodiment in the dismounted position.
Figure 20:
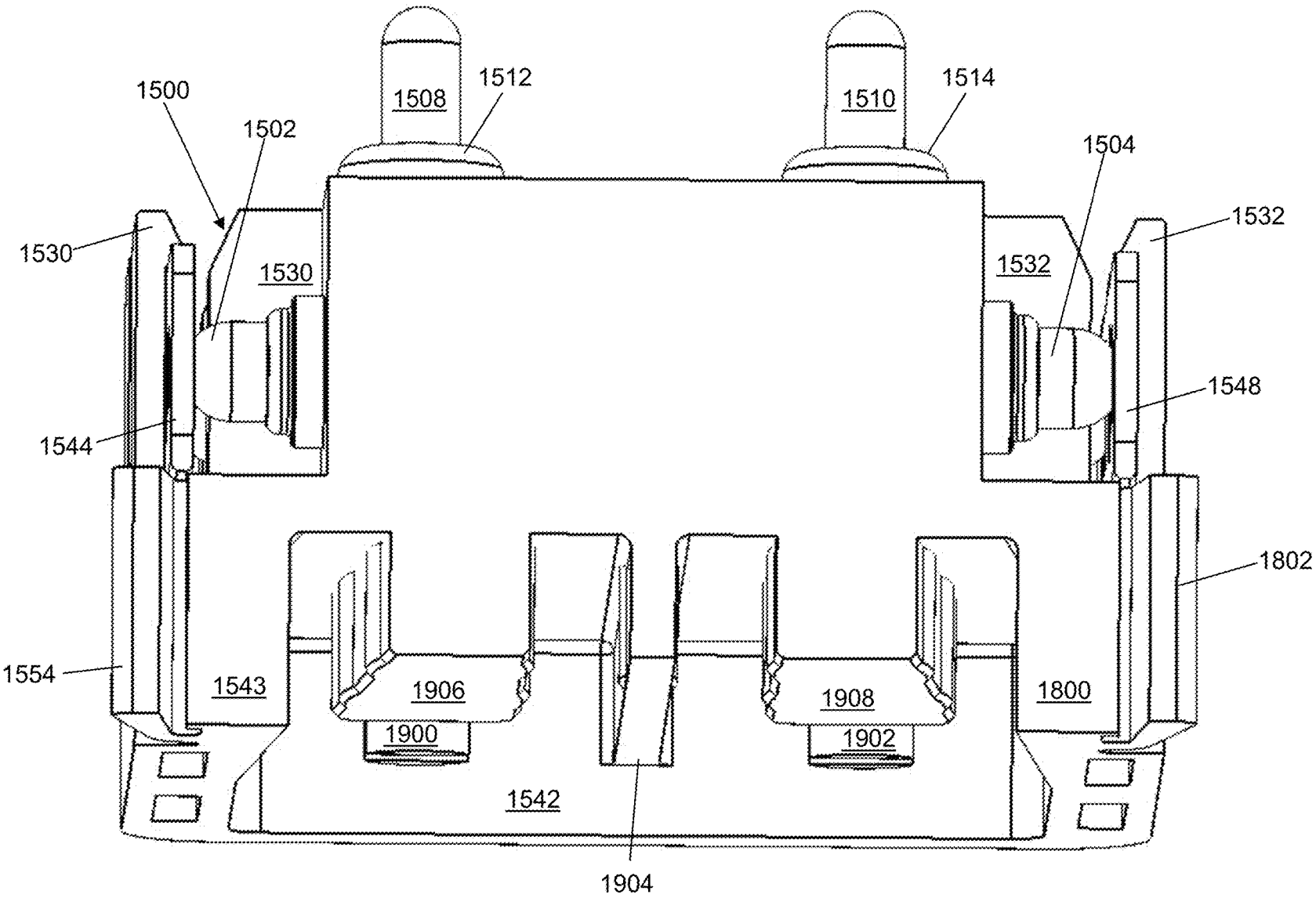
FIG. 20 depicts a back bottom perspective view of the ladder connector of FIG. 15 in accordance with an illustrative embodiment in the dismounted position.
Figure 21:
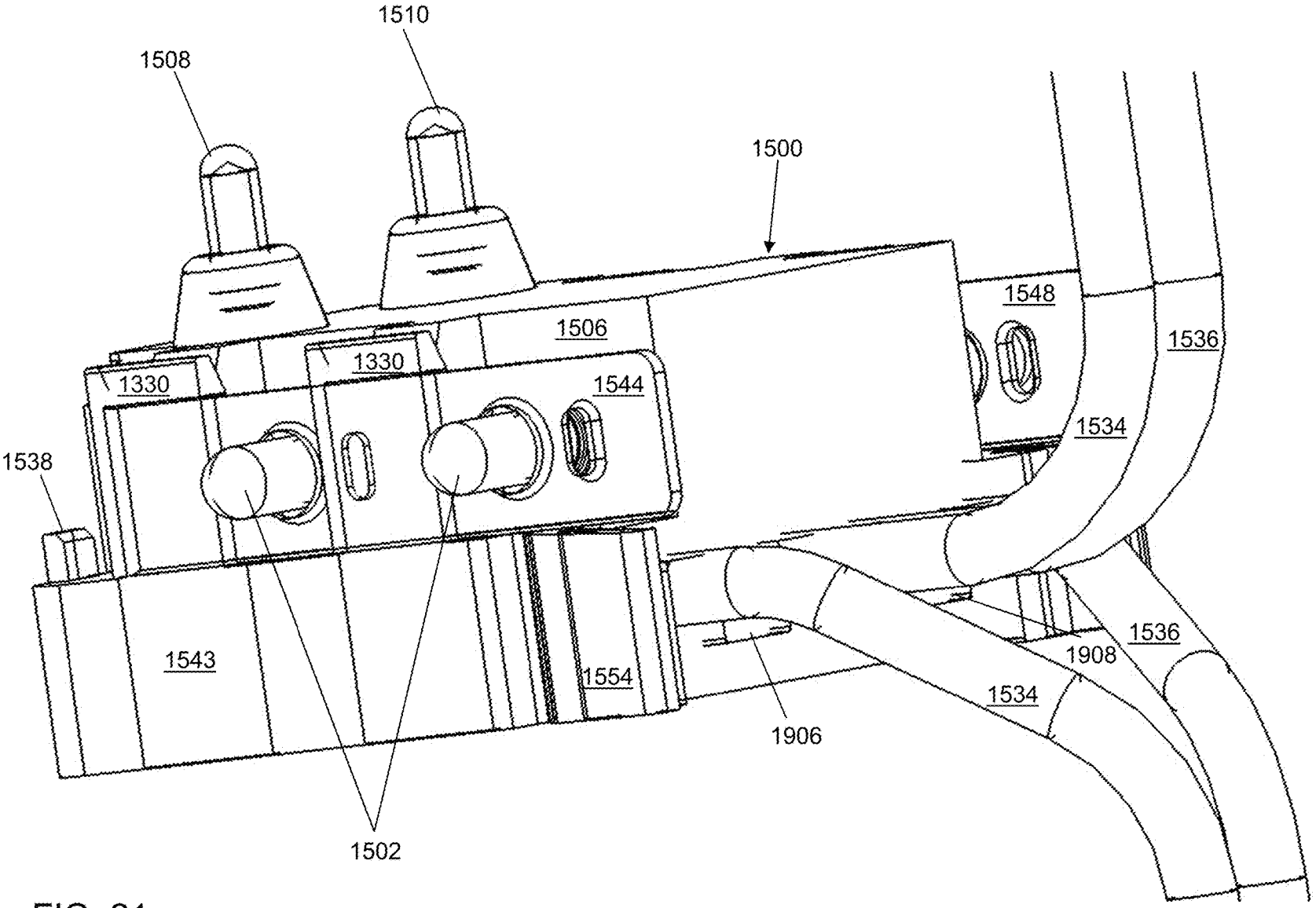
FIG. 21 depicts a back right perspective view of the ladder connector of FIG. 15 in accordance with an illustrative embodiment in the mounted position.

Referring to FIG. 15, a front top perspective view of ladder connector 1500 is shown in accordance with an illustrative embodiment in a mounted position though first right ladder 108 is not shown. Referring to FIG. 17, a top right perspective view of ladder connector 1500 is shown in accordance with an illustrative embodiment in a dismounted position. Referring to FIG. 18, a top left perspective view of ladder connector 1500 is shown in accordance with an illustrative embodiment in the dismounted position. Referring to FIG. 19, a front bottom perspective view of ladder connector 1500 is shown in accordance with an illustrative embodiment in the dismounted position. Referring to FIG. 20, a back bottom perspective view of ladder connector 1500 is shown in accordance with an illustrative embodiment in the dismounted position. Referring to FIG. 21, a back right perspective view of ladder connector 1500 with connecting wires 1534, 1536 is shown in accordance with an illustrative embodiment in the mounted position.

Ladder connector 1500 may include right mounting pins 1502 and left mounting pins 1504 that extend from right and left side walls of a connector body 1506, respectively. In the illustrative embodiment of FIG. 15, ladder connector 1500 further may include a connector base 1507 below connector body 1506 though connector base 1507 and connector body 1506 may be formed from a single piece of material, for example, using a molding process. In the illustrative embodiment of FIG. 15, ladder connector 1500 further may include a right spring-loaded contact pin 1508, a left spring-loaded contact pin 1510, a right cone 1512, a left cone 1514, a right drain wall 1516, a left drain wall 1518, and a sliding wall 1520. Right cone 1512, left cone 1514, right drain wall 1516, left drain wall 1518, sliding wall 1520, connector base 1507, and connector body 1506 may be formed of an insulating material.

Right spring-loaded contact pin 1508 and left spring-loaded contact pin 1510 may be formed of an electrically conductive material and are positioned to abut contact pad 712 and second contact pad 1104, respectively, when right bracket 210 is mounted to first right ladder 108. When right spring-loaded contact pin 1508 and left spring-loaded contact pin 1510 are positioned to abut contact pad 712 and second contact pad 1104, respectively, hook head contact surface 306 of right bracket 210 may rest on a top surface of connector body 1506 between right spring-loaded contact pin 1508 and left spring-loaded contact pin 1510. In an alternative embodiment, hook head contact surface 306 of right bracket 210 may not contact the top surface of connector body 1506.

Right spring-loaded contact pin 1508 and left spring-loaded contact pin 1510 are positioned to align with contact pad 712 and with second contact pad 1104, respectively, when right bracket 210 is mounted to first right ladder 108. When right bracket 210 is mounted to first right ladder 108, right spring-loaded contact pin 1508 and left spring-loaded contact pin 1510 are depressed into connector body 1506 within right cone 1512 and left cone 1514, respectively. Right cone 1512 surrounds right spring-loaded contact pin 1508 and left cone 1514 surrounds left spring-loaded contact pin 1510 to provide separation between the spring-loaded contact pins 1508, 1510 and to prevent any moisture or debris from creating a shorting path between the spring-loaded contact pins 1508, 1510. Right drain wall 1516 extends interior of connector base 1507 and/or connector body 1506 adjacent right spring-loaded contact pin 1508 to allow water or moisture drainage away from right spring-loaded contact pin 1508. Similarly, left drain wall 1518 extends interior of connector base 1507 and/or connector body 1506 adjacent left spring-loaded contact pin 1510 to allow water or moisture drainage away from left spring-loaded contact pin 1510.

In the illustrative embodiment, sliding wall 1520 may form a U-shape that extends around connector body 1506 on three sides and may include a right arm 1544, a front arm 1546, and a left arm 1548. In the illustrative embodiment, sliding wall 1520 includes right blocking aperture walls 1522, left blocking aperture walls 1524, right aperture walls 1526, and left aperture walls 1528. The right blocking aperture walls 1522 and the right aperture walls 1526 are formed through right arm 1544, and the left blocking aperture walls 1524 and the left aperture walls 1528 are formed through left arm 1548. In an alternative embodiment, sliding wall 1520 may not have a U-shape and may be comprised of two walls that separately slide along the right and the left sides of connector body 1506. In the illustrative embodiment, each of the right blocking aperture walls 1522, left blocking aperture walls 1524, right aperture walls 1526, and left aperture walls 1528 include a pair of walls to correspond with the number of right mounting pins 1502 and left mounting pins 1504 that correspond with a number of right ladder connector aperture walls 1308 and left ladder connector aperture walls 1310 at each vertical location.

Connector base 1507 may include a front base wall 1542, a right base wall 1543, and a left base wall 1800 that form a U-shape. A right plurality of tabs 1530 extend up from right base wall 1543 of connector base 1507. A left plurality of tabs 1532 extend up from left base wall 1800 of connector base 1507. A right tab 1538 extends up from a right side of front base wall 1542 of connector base 1507. A left tab 1540 extends up from a left side of front base wall 1542 of connector base 1507.

A right plurality of protrusions 1550 may extend outward from a right side of connector body 1506. The right plurality of protrusions 1550 and the right plurality of tabs 1530 form a first channel within which right arm 1544 of sliding wall 1520 is configured to slide. A left plurality of protrusions 1552 extends outward from a left side of connector body 1506. The left plurality of protrusions 1552 and the left plurality of tabs 1532 form a second channel within which left arm 1548 of sliding wall 1520 is configured to slide.

Right tab 1538, left tab 1540, the right plurality of protrusions 1550, the right plurality of tabs 1530, the left plurality of protrusions 1552, and the left plurality of tabs 1532 mount sliding wall 1520 to connector body 1506 and connector base 1507 while allowing sliding wall 1520 to slide in a horizontal direction to align right blocking aperture walls 1522 and left blocking aperture walls 1524 with right mounting pins 1502 and left mounting pins 1504, respectively, or to align right aperture walls 1526 and left aperture walls 1528 with right mounting pins 1502 and left mounting pins 1504, respectively. Right mounting pins 1502 and left mounting pins 1504 may be spring loaded to be depressed when aligned with right blocking aperture walls 1522 and left blocking aperture walls 1524, respectively, and to be extended when aligned with right aperture walls 1526 and left aperture walls 1528, respectively.

When ladder connector 1500 is mounted to first right ladder 108, front arm 1546 is pressed against a back surface of front wall 1300 of first right ladder 108 aligning right aperture walls 1526 and left aperture walls 1528 with right mounting pins 1502 and left mounting pins 1504, respectively. Right mounting pins 1502 align with and are inserted into a pair of right ladder connector aperture walls 1308, and left mounting pins 1504 align with and are inserted into a pair of left ladder connector aperture walls 1310 to mount ladder connector 1500 to first right ladder 108.

A right compression tab 1554 extends outward from a back portion of right base wall 1543 of connector base 1507. A left compression tab 1802 extends outward from a back portion of left base wall 1800 of connector base 1507. When ladder connector 1500 is mounted to first right ladder 108, right compression tab 1554 presses against an inner surface of right side wall 1302 of first right ladder 108, and left compression tab 1802 presses against an inner surface of left side wall 1304 of first right ladder 108 to further hold ladder connector 1500 in place on first right ladder 108.

When ladder connector 1500 is not mounted to first right ladder 108, right mounting pins 1502 align with and are partially inserted into a pair of right blocking aperture walls 1522, and left mounting pins 1504 align with and are partially inserted into a pair of left blocking aperture walls 1524 to allow ladder connector 1500 to be inserted into first right ladder 108. When ladder connector 1500 is not mounted to first right ladder 108, the partial insertion of right mounting pins 1502 into the pair of right blocking aperture walls 1522 and the partial insertion of left mounting pins 1504 into the pair of left blocking aperture walls 1524 holds sliding wall 1520 in the blocked position until front arm 1546 is pressed against the back surface of front wall 1300 of first right ladder 108 to slide sliding wall 1520 horizontally toward connector body 1506. Again, when sliding wall 1520 is slid horizontally toward connector body 1506, right mounting pins 1502 align with and are inserted into a pair of right ladder connector aperture walls 1308 by action of springs, and left mounting pins 1504 align with and are inserted into a pair of left ladder connector aperture walls 1310 by action of springs to mount ladder connector 1500 to first right ladder 108.

Again, right spring-loaded contact pin 1508 and left spring-loaded contact pin 1510 are positioned to align with contact pad 712 and with second contact pad 1104, respectively, when right bracket 210 is mounted to first right ladder 108. Right spring-loaded contact pin 1508 and left spring-loaded contact pin 1510 are mounted to slide up and down within right cone 1512 and left cone 1514, respectively, when weight is applied to a respective spring-loaded contact pin. Illustrative spring-loaded contact pins are those offered by PRECI-DIP SA of Delémont, Switzerland. Each spring-loaded contact pin may be designed such that it operates in a specific working range to prolong a life of the pin, is plated to prevent corrosion build up, and/or is designed to operate in the conditions to which the interior space of the device is exposed such as the interior space of a freezer, of a wine closet, and/or of refrigerator 100. The spring-loaded contact pin provides ease of use to allow the user to add power or communication to shelf 200 without making any other connections.

A right solder post 1900 and a left solder post 1902 extend from a bottom surface of connector base 1507. A right wire 1534 is connected to a first electrical signal receiver and/or generator and to right solder post 1900, and a left wire 1536 is connected to a second electrical signal receiver and/or generator and to left solder post 1902. Right solder post 1900 is electrically connected to right spring-loaded contact pin 1508 so that the first electrical signal receiver and/or generator is electrically connected through right wire 1534 to the second end of wire 900 to send and/or to receive the electrical signal to/from the object to which wire 900 is connected. Left solder post 1902 is electrically connected to left spring-loaded contact pin 1510 so that the second electrical signal receiver and/or generator is electrically connected through left wire 1536 to the second end of second wire 1204 to send and/or to receive the electrical signal to/from the object to which second wire 1204 is connected. Right wire 1534 may be covered in an insulating material except where contact is made with right solder post 1900 and with the first electrical signal receiver and/or generator. Left wire 1536 may be covered in an insulating material except where contact is made with left solder post 1902 and with the second electrical signal receiver and/or generator.

Connector base 1507 may further include a center base wall 1904, a right base platform 1906, and a left base platform 1908. Center base wall 1904 extends away from front base wall 1542 generally parallel to and approximately centered between right base wall 1543 and left base wall 1800. Right base platform 1906 extends downward to define a first wire channel between right base wall 1543 and right base platform 1906, through right solder post 1900, and between right base platform 1906 and center base wall 1904. Right wire 1534 is wound within the first wire channel. Left base platform 1908 extends downward to define a second wire channel between left base wall 1800 and left base platform 1908, through left solder post 1902, and between left base platform 1908 and center base wall 1904. Left wire 1536 is wound within the second wire channel. A plurality of protrusions 1910 may extend outward from right base wall 1543, from either side of center base wall 1904, from left base wall 1800, from either side of right base platform 1906, and/or from either side of left base platform 1908 to assist in holding right wire 1534 and left wire 1536 wound around right base platform 1906 and left base platform 1908, respectively.

In the illustrative embodiments of FIGS. 15 and 17 to 21, ladder connector 1500 includes left and right elements because ladder connector 1500 is designed to mate with both first shelf connector 500 and second shelf connector 502. For example, ladder connector 1500 includes both right spring-loaded contact pin 1508 and left spring-loaded contact pin 1510. In alternative embodiments, ladder connector 1500 may include a greater or a fewer number of spring-loaded contact pins with the associated elements based on a number of shelf connectors mounted to ladder connector 1500 using a bracket such as right bracket 210 or left bracket 214.

Figure 22:
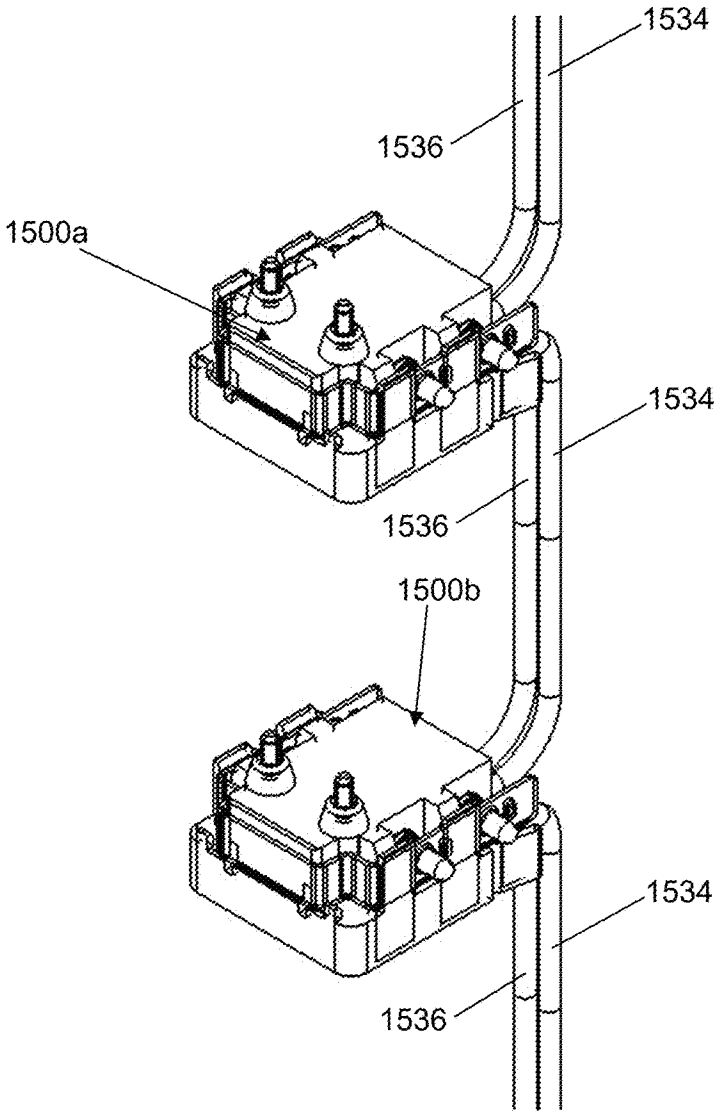
FIG. 22 depicts a front perspective view of a plurality of ladder connectors as shown in FIG. 15 connected in series in accordance with an illustrative embodiment.

Ladder connectors with the same or a different number of spring-loaded contact pins may be placed at one or more shelf mounting locations on first right ladder 108. Referring to FIG. 22, a first ladder connector 1500*a* and a second ladder connector 1500*b* are connected in series by right wire 1534 and by left wire 1536. First ladder connector 1500*a* and second ladder connector 1500*b* are each instances of ladder connector 1500. When no object needing the electrical signal is associated with shelf 200, wire 900 and/or second wire 1204 may be capped so that no current flows in wire 900 and/or second wire 1204. As another option, right wire 1534 and/or left wire 1536 may not make an electrical contact with right solder post 1900 and/or left solder post 1902, respectively, when no object needing the electrical signal is associated with shelf 200.

Figure 23:
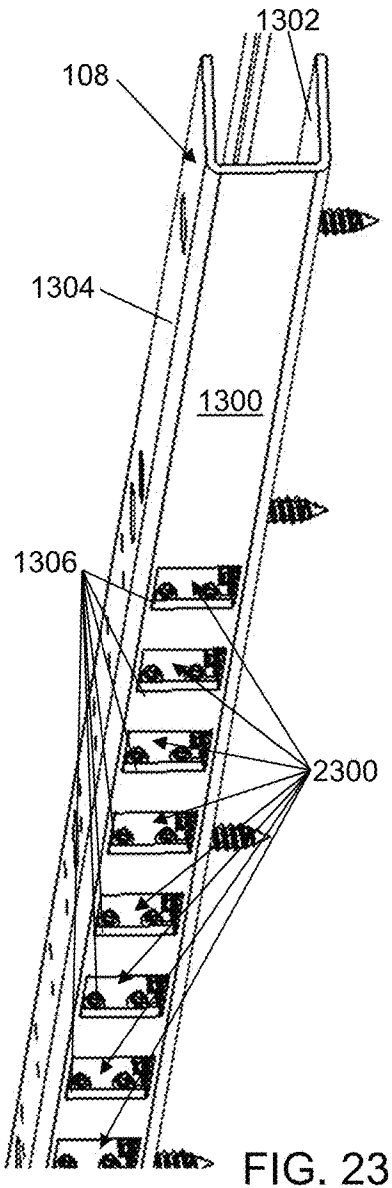
FIG. 23 depicts a front left perspective view of the plurality of ladder connectors mounted to the ladder of FIG. 13 in accordance with an illustrative embodiment.

Referring to FIG. 23, a front left perspective view of a plurality of ladder connectors 2300 are shown mounted to first right ladder 108 in accordance with an illustrative embodiment. Referring to FIG. 24, a front left perspective view of ladder connector 1500 mounted to first right ladder 108 is shown in accordance with an illustrative embodiment. Right mounting pins 1502 and left mounting pins 1504 are aligned with and inserted into right ladder connector aperture walls 1308 and left ladder connector aperture walls 1310, respectively, and front base wall 1542 of connector base 1507 is pressed against an inside surface of front wall 1300 of first right ladder 108.

Figure 16:
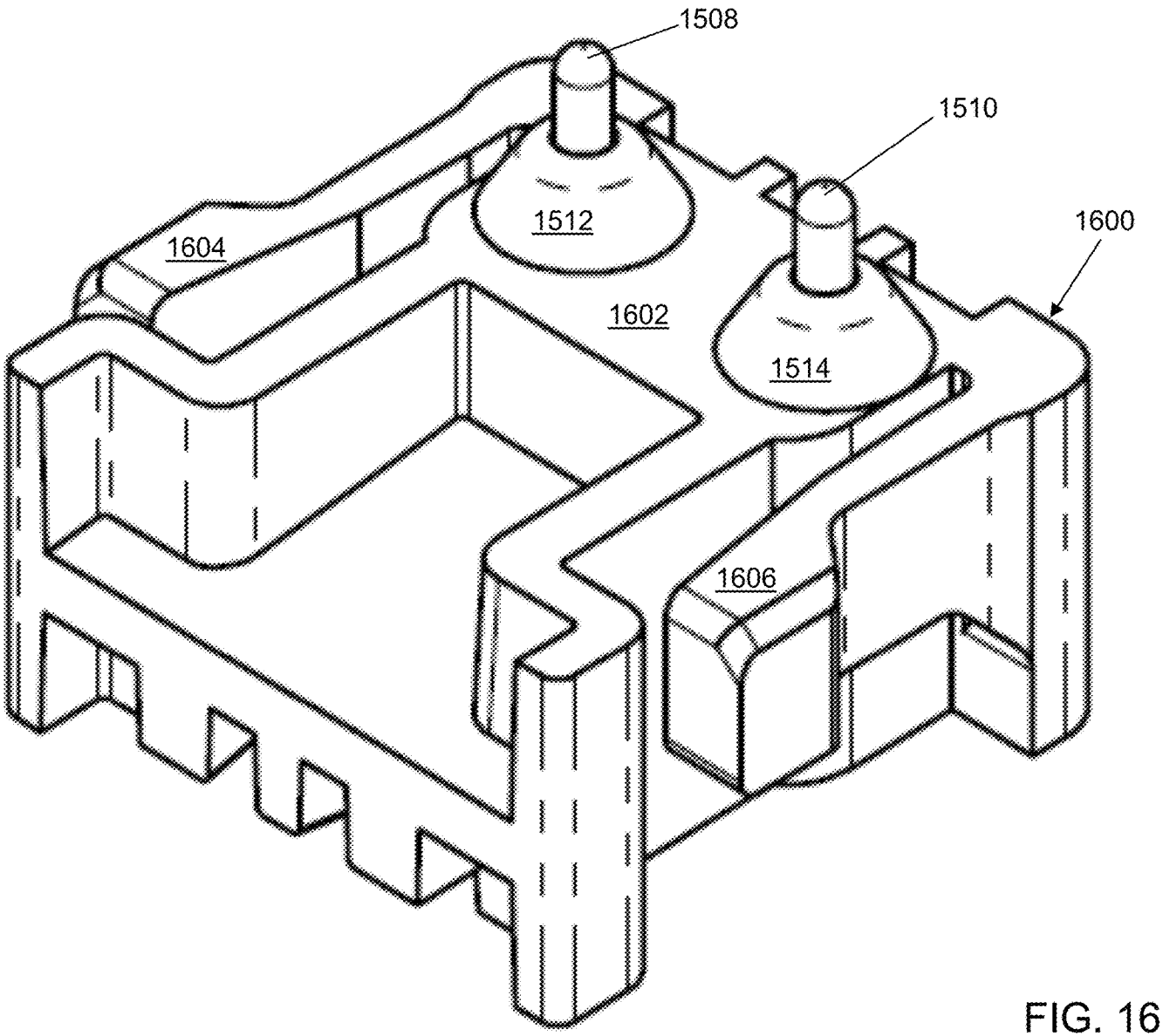
FIG. 16 depicts a back top perspective view of a second ladder connector in accordance with an illustrative embodiment.
Figure 25:
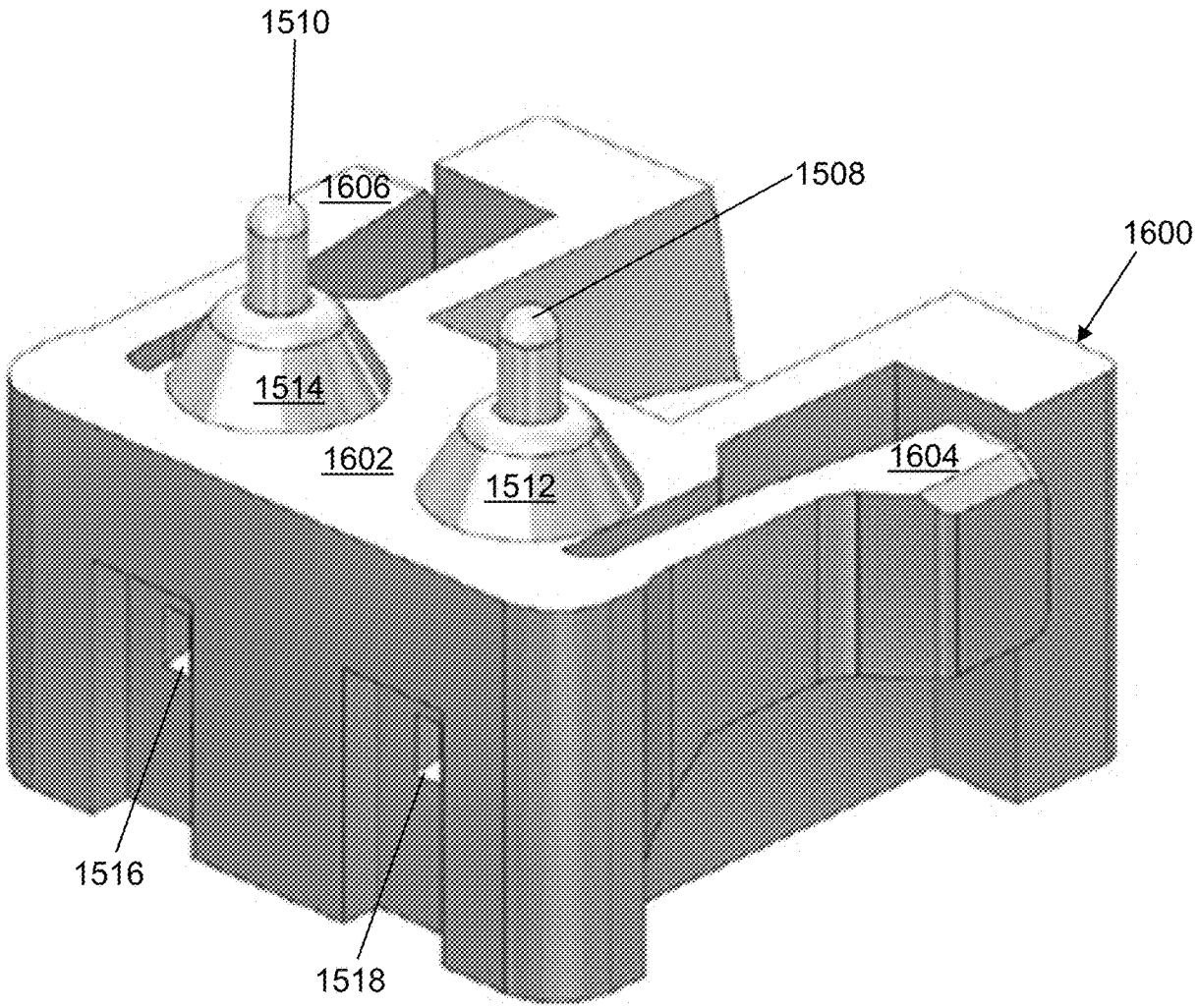
FIG. 25 depicts a front right perspective view of the second ladder connector of FIG. 16 in accordance with an illustrative embodiment.
Figure 26:
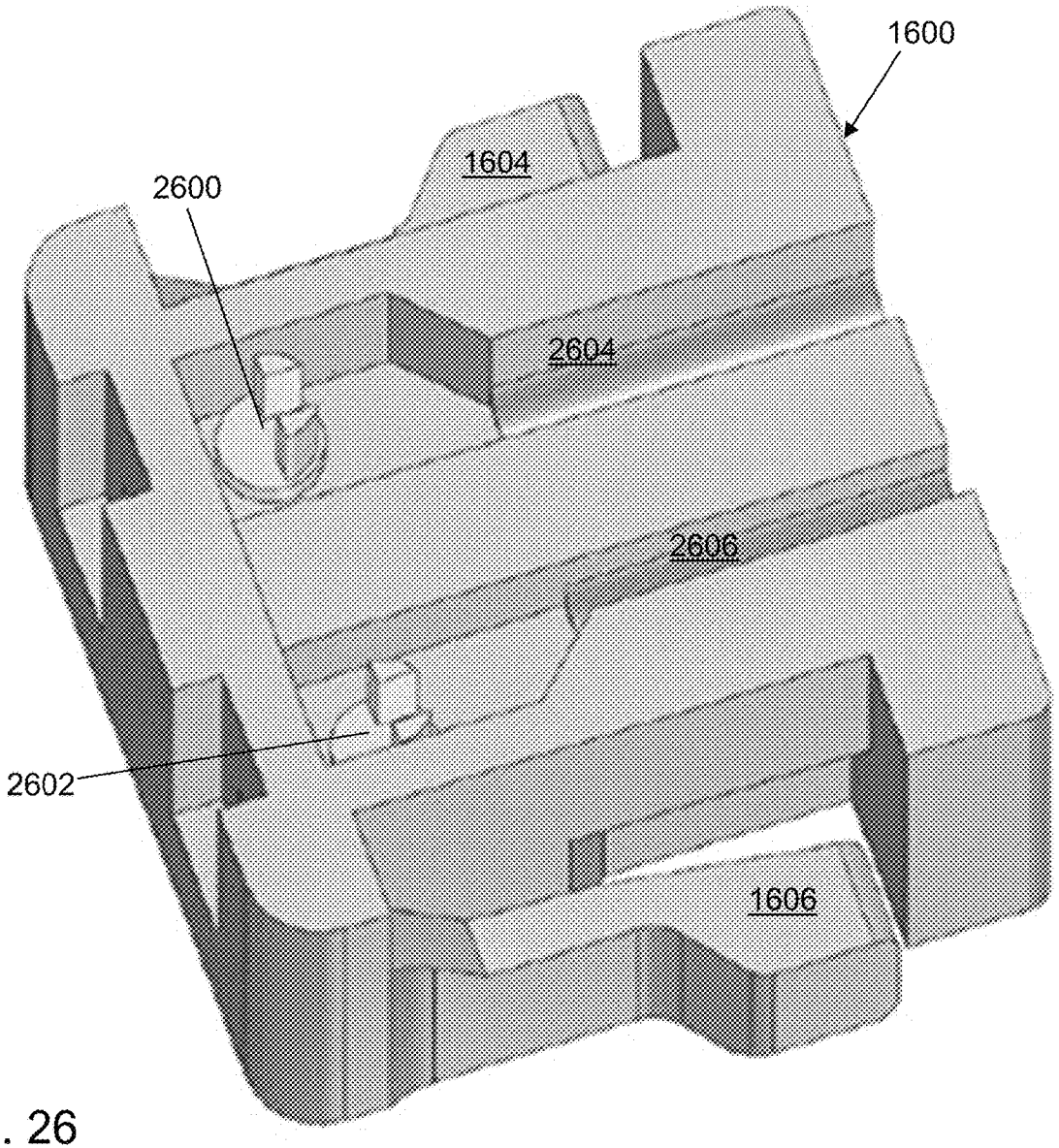
FIG. 26 depicts a front bottom perspective view of the second ladder connector of FIG. 16 in accordance with an illustrative embodiment.

Referring to FIG. 16, second ladder connector 1600 includes a second connector body 1602, a right mounting tab 1604, and a left mounting tab 1606 that extend from either side of second connector body 1602 in accordance with an illustrative embodiment. Referring to FIG. 25, a front right side perspective view of second ladder connector 1600 is shown in accordance with an illustrative embodiment. Referring to FIG. 26, a front bottom perspective view of second ladder connector 1600 is shown in accordance with an illustrative embodiment. Similar to ladder connector 1500, second ladder connector 1600 may include right spring-loaded contact pin 1508, left spring-loaded contact pin 1510, right cone 1512, left cone 1514, right drain wall 1516, and left drain wall 1518 though not sliding wall 1520. Similar to ladder connector 1500, second ladder connector 1600 may include a second right solder post 2600 and a second left solder post 2602 that extend from a bottom surface of second connector body 1602 and electrically connect to right spring-loaded contact pin 1508 and to left spring-loaded contact pin 1510, respectively.

Figure 27:
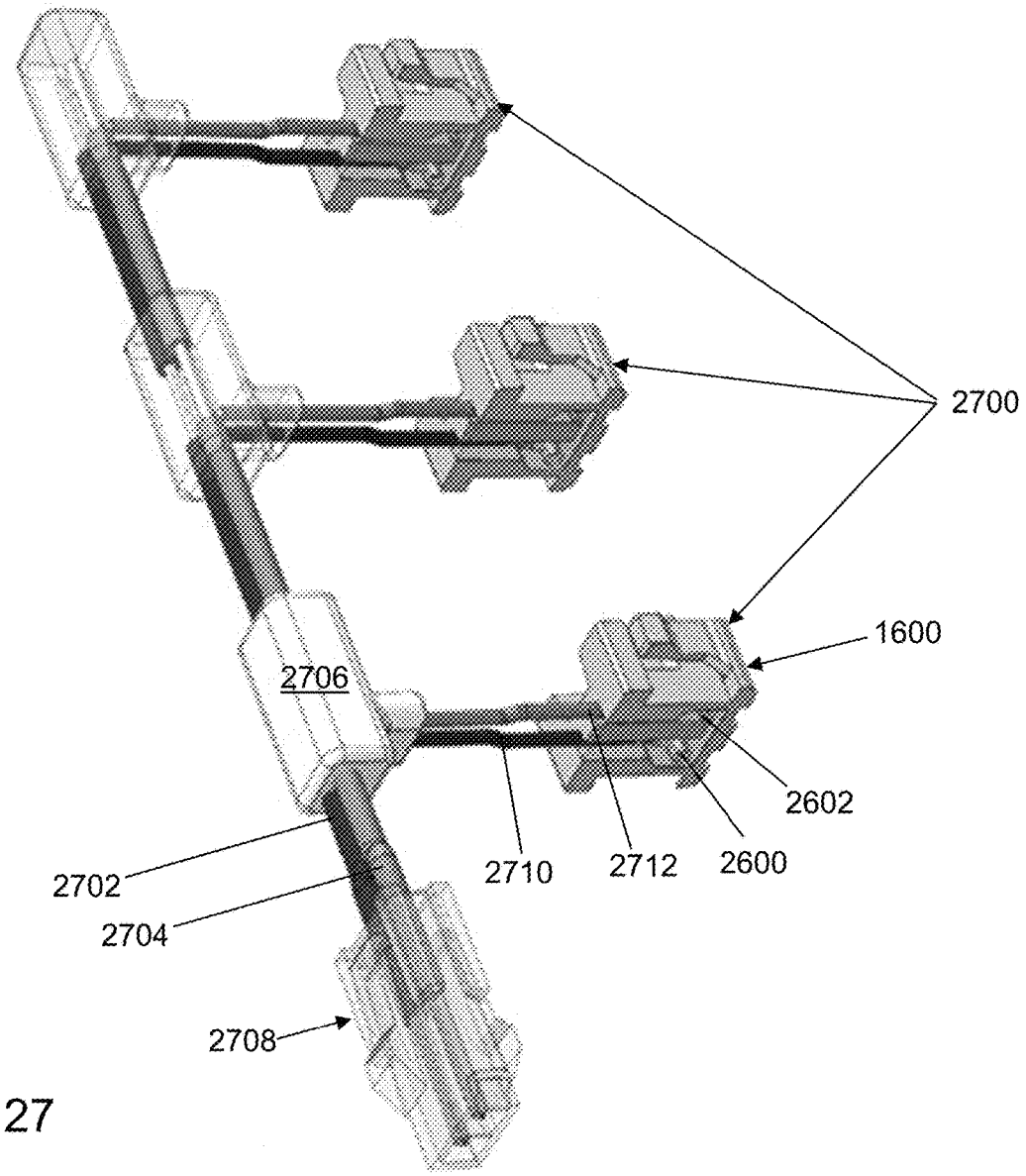
FIG. 27 depicts a back, left perspective view of a plurality of second ladder connectors as shown in FIG. 16 connected in series in accordance with an illustrative embodiment.

Referring to FIG. 27, a plurality of second ladder connectors 2700 that include second ladder connector 1600 shown in accordance with an illustrative embodiment. The plurality of second ladder connectors 2700 are connected in series by a third wire 2702 and by a fourth wire 2704 that are connected within a wire plug 2708 that may electrically connect with a controller such as refrigerator controller 3100 (shown referring to FIG. 31) or a power source. The controller may be included on a printed circuit board (not shown). A splitter housing 2706 covers a split connection between third wire 2702 and a first connector wire 2710 and between fourth wire 2704 and a second connector wire 2712. First connector wire 2710 is mounted within a third wire channel 2604 and electrically connected to second right solder post 2600. Second connector wire 2712 is mounted within a fourth wire channel 2606 and electrically connected to second left solder post 2602. Each additional second ladder connector of the plurality of second ladder connectors 2700 may be similarly connected to third wire 2702 and to fourth wire 2704 to provide a similar electrical connection to contact pad 712 and to second contact pad 1104.

Figure 28C:
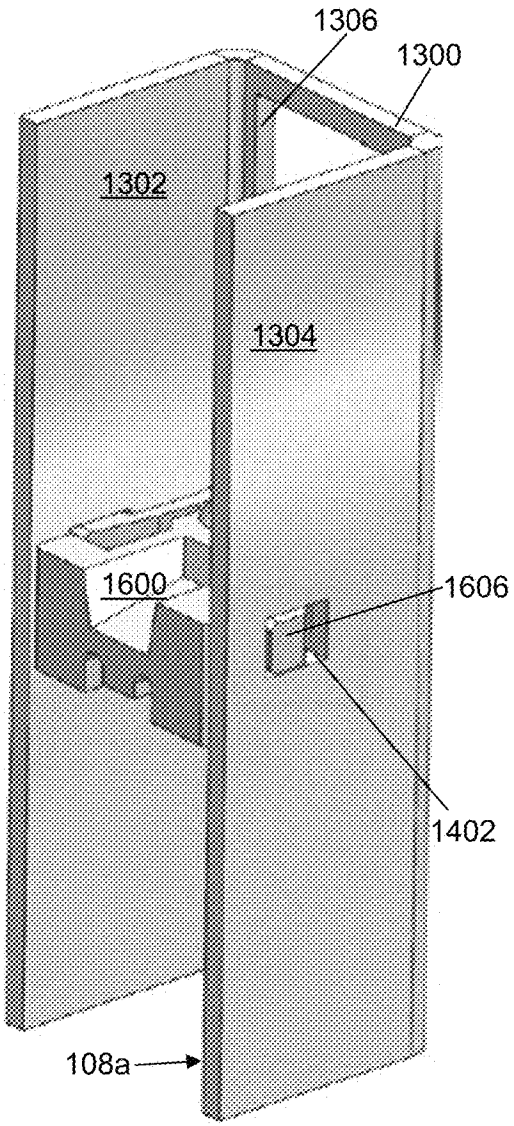
FIG. 28C depicts the second ladder connector of FIG. 16 mounted to the second ladder of FIG. 14 in accordance with an illustrative embodiment.
Figure 28B:
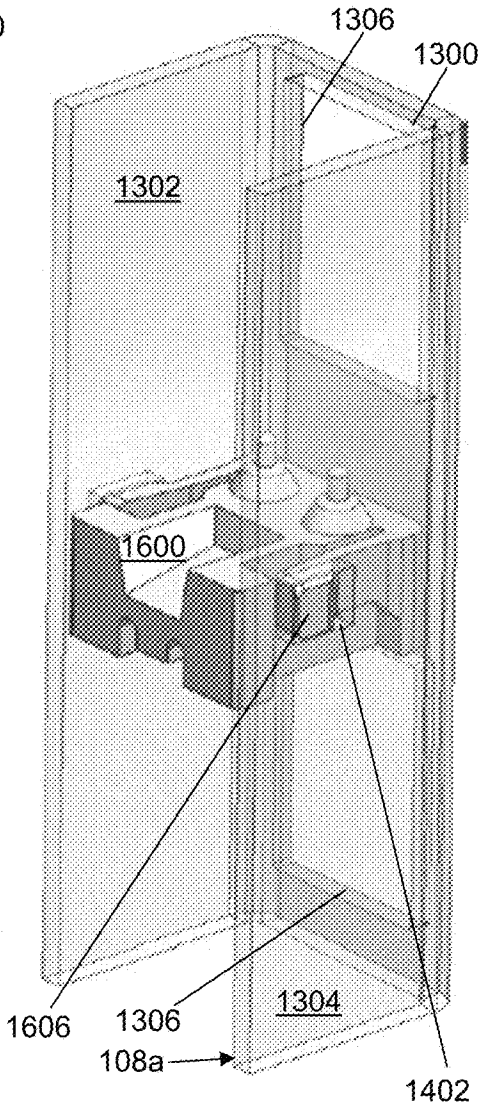
FIG. 28B depicts the second ladder connector of FIG. 16 mounted to the second ladder of FIG. 14 in accordance with an illustrative embodiment with the ladder transparent.
Figure 28A:
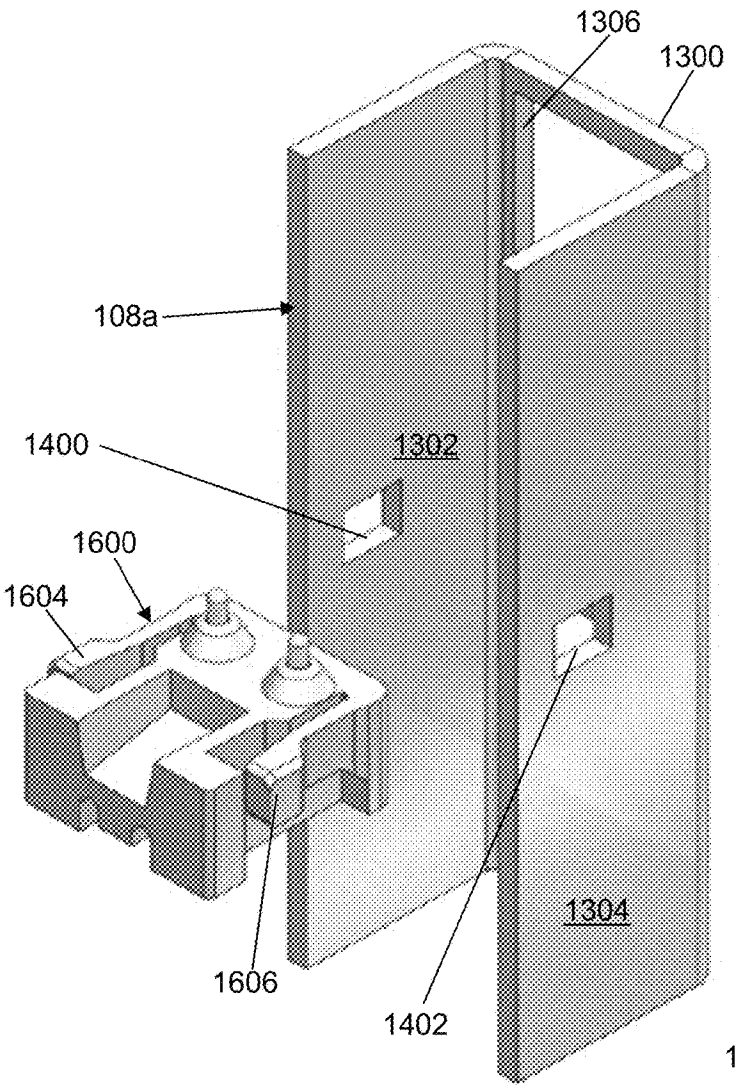
FIG. 28A depicts the second ladder connector of FIG. 16 aligned for mounting to the second ladder of FIG. 14 in accordance with an illustrative embodiment.

Referring to FIG. 28A, second ladder connector 1600 is aligned for mounting to second right ladder 108*a* in accordance with an illustrative embodiment. Referring to FIG. 288, second ladder connector 1600 is shown mounted to second right ladder 108*a* in accordance with an illustrative embodiment with second right ladder 108*a* shown transparent. Referring to FIG. 28C, second ladder connector 1600 is shown mounted to second right ladder 108*a* in accordance with an illustrative embodiment. Right mounting tab 1604 is inserted in a first aperture wall of the plurality of right ladder connector aperture walls 1400, and left mounting tab 1606 is inserted in a first aperture wall of the plurality of left ladder connector aperture walls 1402.

Figure 29:
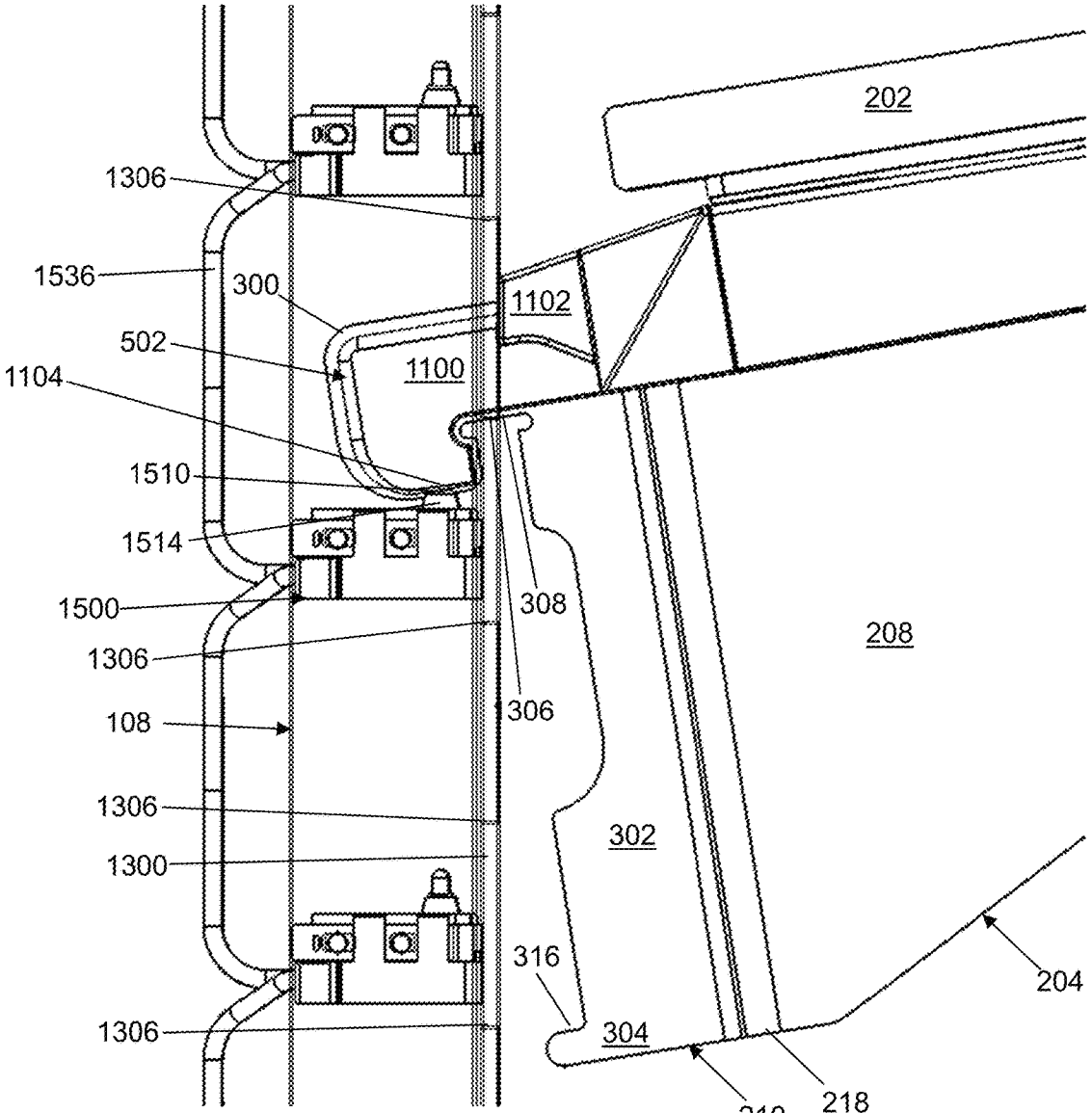
FIG. 29 depicts the second shelf connector of FIG. 6 in the process of being mounted on the ladder connector of FIG. 15 in accordance with an illustrative embodiment.
Figure 30:
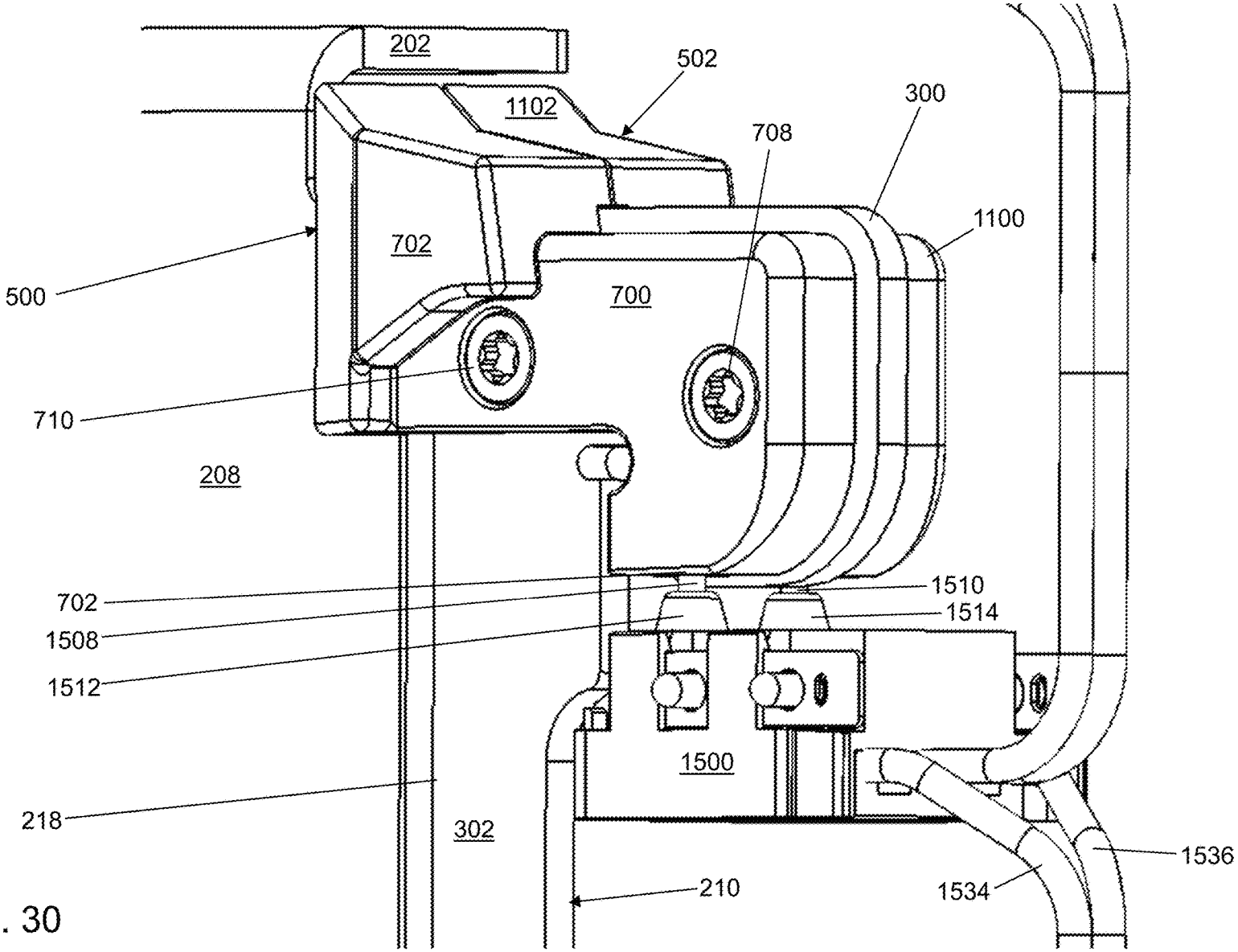
FIG. 30 depicts the first shelf connector and the second shelf connector of FIG. 6 mounted on the ladder connector of FIG. 15 in accordance with an illustrative embodiment.

Referring to FIG. 29, second shelf connector 502 is in the process of being mounted on ladder connector 1500 with first right ladder 108 transparent in accordance with an illustrative embodiment. Referring to FIG. 30, first shelf connector 500 and second shelf connector 502 are mounted on ladder connector 1500 with first right ladder 108 removed in accordance with an illustrative embodiment. In an alternative embodiment, first shelf connector 500 and/or second shelf connector 502 may be similarly positioned for mounting on second ladder connector 1600. Ladder connector 1500 is mounted to first right ladder 108 by inserting head portion 300 of right bracket 210 into the shelf bracket aperture wall of the plurality of shelf bracket aperture walls 1306. Ladder mounting surface 308 rests on a bottom surface of the shelf bracket aperture wall and second contact pad 1104 of second shelf connector 502 contacts left spring-loaded contact pin 1510 while foot contact surface 316 will abut a top surface of the second shelf bracket aperture wall that is below the shelf bracket aperture wall when mounting of second shelf connector 502 to ladder connector 1500 is complete.

There may be a wiping action on right spring-loaded contact pin 1508 and/or left spring-loaded contact pin 1510 when mounting first shelf connector 500 and/or second shelf connector 502 to ladder connector 1500 or to second ladder connector 1600 to ensure better contact surface conditions for lower contact resistance and to remove possible corrosion that may have built up. Use of spring-loaded contact pins such as right spring-loaded contact pin 1508 and left spring-loaded contact pin 1510 keeps a voltage of the electrical signals applied to contact pad 712 and to second contact pad 1104 isolated from each other and from the interior components of the device such as refrigerator 100. Additionally, neither shelf bracket 210 nor the ladder need to be energized as compared to existing systems. By isolating the bus voltages from each other, all metal interiors, cold plate, ladders, sidewalls, etc. can be used instead of plastic components to provide the insulation.

Figure 31:
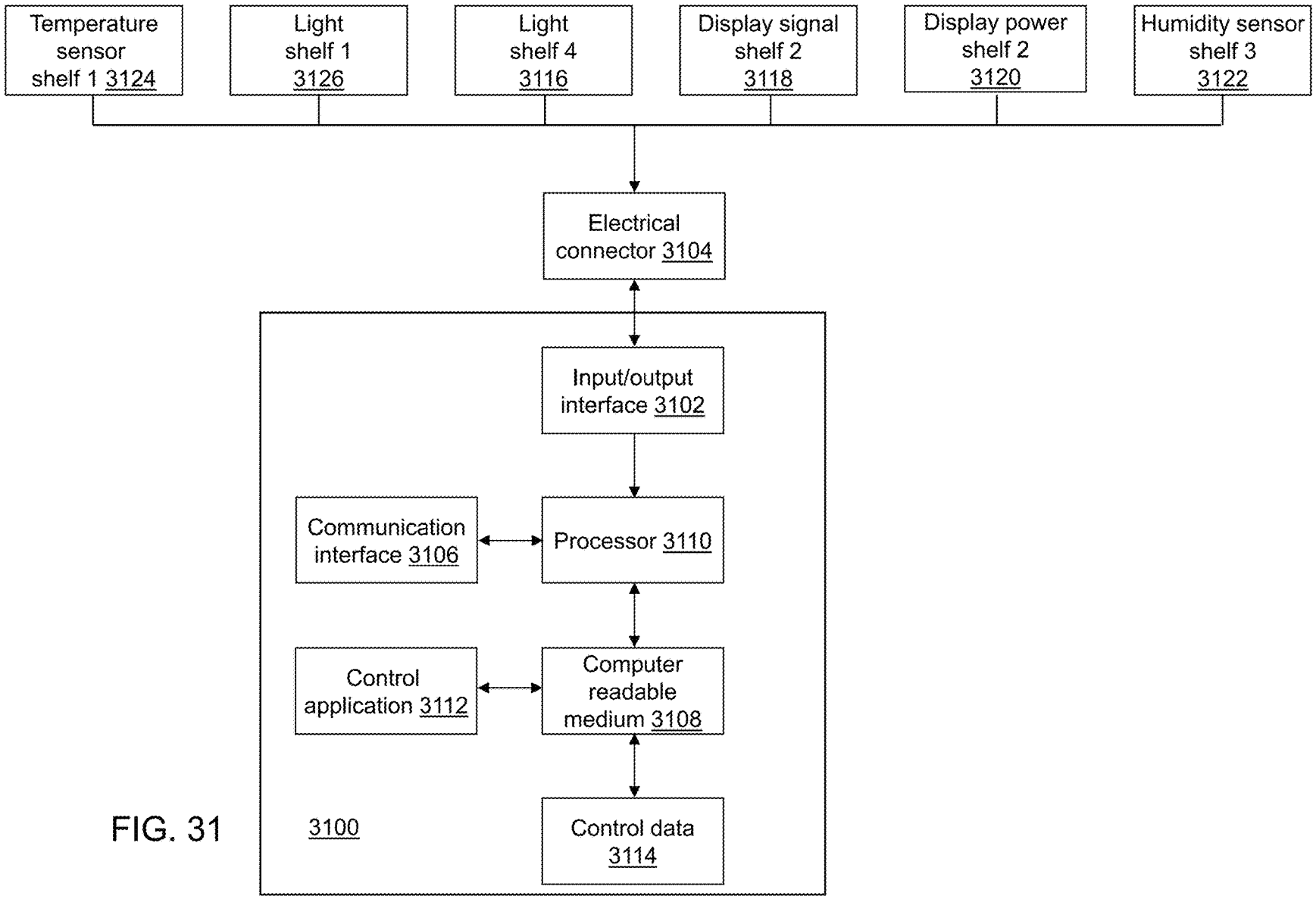
FIG. 31 depicts a block diagram of a refrigerator controller of the refrigerator of FIG. 1 in accordance with an illustrative embodiment.

Referring to FIG. 31, a block diagram of a refrigerator controller 3100 is shown in accordance with an illustrative embodiment for refrigerator 100. In alternative embodiments, different types of controller may be used with different illustrative devices. Refrigerator controller 3100 may include an input/output (110) interface 3102, a communication interface 3106, a non-transitory computer-readable medium 3108, a processor 3110, a control application 3112, and control data 3114. Fewer, different, and/or additional components may be incorporated into refrigerator controller 3100.

For example, refrigerator controller 3100 controls a flow of refrigerant through one or more refrigeration systems of refrigerator 100 where a refrigeration system cools air provided to one or more compartments. Refrigerator 100 may include one or more refrigeration systems. For illustration, a refrigeration system may include a compressor, a condenser, an expansion valve, a dryer, and/or an evaporator through which the refrigerant flows as well as various motors that control operation of the refrigeration system components. An air circulation system that includes a fan, an air duct, and/or a return duct may be associated with each compartment to provide cooled air from the associated evaporator to the enclosed space and to return air from the enclosed space to the associated evaporator to maintain the air in the enclosed space at the temperature selected using the associated temperature control.

I/O interface 3102 provides an interface for receiving information from a user or another device for entry into refrigerator controller 3100 and/or for outputting information for review by a user of refrigerator controller 3100 and/or for use by another application or device as understood by those skilled in the art. I/O interface 3102 may interface with various I/O technologies including, but not limited to, an electrical connector 3104 such as wire plug 2708. Electrical connector 3104 may interface with various devices including, but not limited to, a temperature sensor shelf 1 3124, a light shelf 1 3126, a light shelf 4 3116, a display signal shelf 2 3118, a display power shelf 2 3120, a humidity sensor shelf 3 3122, etc. For example, electrical connector 3104 may be connected to temperature sensor shelf 1 3124 that is mounted to a first shelf 200 and that may produce a sensor signal value representative of a measure of the temperature in an environment surrounding shelf 1 where the signal is sent to refrigerator controller 3100 through ladder connector 1500 or second ladder connector 1600 and through first shelf connector 500 mounted to shelf bracket 210 of shelf 1. As another example, electrical connector 3104 may be connected to provide power to light shelf 1 3126 through ladder connector 1500 or second ladder connector 1600 and through second shelf connector 502 mounted to shelf bracket 210 of shelf 1. As yet another example, electrical connector 3104 may be connected to provide power to light shelf 4 3116 through ladder connector 1500 or second ladder connector 1600 and through first shelf connector 500 mounted to shelf bracket 210 of shelf 4. As still another example, electrical connector 3104 may be connected to provide power to display power shelf 2 3120 and to provide a data signal to display signal shelf 2 3118 through ladder connector 1500 or second ladder connector 1600 and through three shelf connectors mounted to one or more shelf brackets of shelf 2. The I/O interface technology further may be accessible by refrigerator controller 3100 through communication interface 3106. Refrigerator controller 3100 may have one or more I/O interfaces that use the same or a different I/O interface technology. Though shown as single wires, the same or a different wire may be connected to each of temperature sensor shelf 1 3124, light shelf 1 3126, light shelf 4 3116, display signal shelf 2 3118, display power shelf 2 3120, humidity sensor shelf 3 3122, etc. to provide a separate control of each device.

Communication interface 3106 provides an interface for receiving and transmitting data between devices using various protocols, transmission technologies, and media as understood by those skilled in the art. Communication interface 3106 may support communication using various transmission media that may be wired and/or wireless. Refrigerator controller 3100 may have one or more communication interfaces that use the same or a different communication interface technology. For example, refrigerator controller 3100 may support communication using an Ethernet port, a Bluetooth antenna, a telephone jack, a USB port, etc. Data and messages may be transferred between refrigerator controller 3100 and another device using communication interface 3106.

Computer-readable medium 3108 is an electronic holding place or storage for information so the information can be accessed by processor 3110 as understood by those skilled in the art. Computer-readable medium 3108 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., compact disc (CD), digital versatile disc (DVD), . . . ), smart cards, flash memory devices, etc. Refrigerator controller 3100 may have one or more computer-readable media that use the same or a different memory media technology. For example, computer-readable medium 3108 may include different types of computer-readable media that may be organized hierarchically to provide efficient access to the data stored therein as understood by a person of skill in the art. As an example, a cache may be implemented in a smaller, faster memory that stores copies of data from the most frequently/recently accessed main memory locations to reduce an access latency. Refrigerator controller 3100 also may have one or more drives that support the loading of a memory media such as a CD, DVD, an external hard drive, etc. One or more external hard drives further may be connected to refrigerator controller 3100 using communication interface 3106.

Processor 3110 executes instructions as understood by those skilled in the art. The instructions may be carried out by a special purpose computer, logic circuits, or hardware circuits. Processor 3110 may be implemented in hardware and/or firmware. Processor 3110 executes an instruction, meaning it performs/controls the operations called for by that instruction. The term "execution" is the process of running an application or the carrying out of the operation called for by an instruction. The instructions may be written using one or more programming language, scripting language, assembly language, etc. Processor 3110 operably couples with I/O interface 3102, with communication interface 3106, and with computer-readable medium 3108 to receive, to send, and to process information. Processor 3110 may retrieve a set of instructions from a permanent memory device and copy the instructions in an executable form to a temporary memory device that is generally some form of RAM. Refrigerator controller 3100 may include a plurality of processors that use the same or a different processing technology.

Control application 3112 performs operations associated with controlling the operation of refrigerator 100 to cool the various compartments to the selected temperature as well as to control operation of temperature sensor shelf 1 3124, light shelf 1 3126, light shelf 4 3116, display signal shelf 2 3118, display power shelf 2 3120, humidity sensor shelf 3 3122, etc. The operations may be implemented using hardware, firmware, software, or any combination of these methods. Referring to the example embodiment of FIG. 31, control application 3112 is implemented in software (comprised of computer-readable and/or computer-executable instructions) stored in computer-readable medium 3108 and accessible by processor 3110 for execution of the instructions that embody the operations of control application 3112. Control application 3112 may be written using one or more programming languages, assembly languages, scripting languages, etc. Control data may include any data associated with control of refrigerator 100.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled relative to a front on which a door is mounted.

As used in this disclosure, the term "mount" includes join, unite, connect, couple, associate, insert, hang, hold, affix, attach, fasten, bind, paste, secure, bolt, screw, rivet, solder, weld, glue, adhere, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A shelf electrical signal connector comprising:

a ladder connector configured to mount to a ladder of a shelving system, wherein the ladder connector comprises a spring-loaded contact pin electrically connected to a first wire configured to carry an electrical signal, the spring-loaded contact pin formed of an electrically conductive material and mounted to extend up from a top surface of the ladder connector; and a shelf connector configured to mount to a shelf bracket, wherein the shelf connector includes a contact pad connected to a second wire, the contact pad formed of an electrically conductive material, wherein the contact pad abuts and rests on top of the spring-loaded contact pin to electrically connect the first wire to the second wire when the shelf bracket is mounted to the ladder of the shelving system.

2. The shelf electrical signal connector of claim 1, wherein the first wire is electrically connected to a controller and wherein the second wire is connected to an electrical device.

3. The shelf electrical signal connector of claim 2, wherein the controller is configured to communicate a data signal to the electrical device through the first wire and the second wire.

4. The shelf electrical signal connector of claim 1, wherein the ladder connector further comprises a second spring-loaded contact pin electrically connected to a third wire configured to carry a second electrical signal, the second spring-loaded contact pin formed of the electrically conductive material.

5. The shelf electrical signal connector of claim 4, further comprising a second shelf connector configured to mount to the shelf bracket, wherein the second shelf connector includes a second contact pad connected to a fourth wire, the second contact pad formed of the electrically conductive material, wherein the second contact pad abuts and rests on top of the second spring-loaded contact pin to electrically connect the third wire to the fourth wire when the shelf bracket is mounted to the ladder of the shelving system.

6. The shelf electrical signal connector of claim 1, wherein the ladder connector further comprises a connector body and a cone, wherein the cone extends up from the connector body, wherein the spring-loaded contact pin extends up through and above a center of the cone, wherein the cone is formed of an insulating material.

7. The shelf electrical signal connector of claim 1, further comprising:

a second ladder connector configured to mount to a second ladder of the shelving system, wherein the second ladder connector comprises a second spring-loaded contact pin electrically connected to a third wire configured to carry a second electrical signal, the second spring-loaded contact pin formed of the electrically conductive material and mounted to extend up from a top surface of the second ladder connector; and a second shelf connector configured to mount to a second shelf bracket, wherein the second shelf connector includes a second contact pad connected to a fourth wire, the second contact pad formed of the electrically conductive material, wherein the second contact pad abuts and rests on top of the second spring-loaded contact pin to electrically connect the third wire to the fourth wire when the second shelf bracket is mounted to the second ladder of the shelving system.

8. The shelf electrical signal connector of claim 7, wherein the ladder connector further comprises a third spring-loaded contact pin electrically connected to a fifth wire configured to carry a third electrical signal, the third spring-loaded contact pin formed of the electrically conductive material.

9. The shelf electrical signal connector of claim 8, further comprising a third shelf connector configured to mount to the shelf bracket, wherein the third shelf connector includes a third contact pad connected to a sixth wire, the third contact pad formed of the electrically conductive material, wherein the third contact pad abuts and rests on top of the third spring-loaded contact pin to electrically connect the fifth wire to the sixth wire when the shelf bracket is mounted to the ladder of the shelving system.

10. The shelf electrical signal connector of claim 1, wherein the ladder connector further comprises a connector body, wherein the first wire is wound around a portion of the connector body.

11. The shelf electrical signal connector of claim 1, wherein the ladder connector further comprises a connector body, wherein the first wire is connected to a solder post mounted to the connector body.

12. The shelf electrical signal connector of claim 1, wherein the shelf connector has a hook shaped portion, wherein the contact pad is mounted to a bottom surface of the hook shaped portion.

13. The shelf electrical signal connector of claim 1, wherein the second wire is connected to the contact pad within a body of the shelf connector.

14. A shelf power system comprising:

a ladder;

a ladder connector mounted to the ladder, wherein the ladder connector comprises a spring-loaded contact pin electrically connected to a first wire configured to carry an electrical signal, the spring-loaded contact pin formed of an electrically conductive material and mounted to extend up from a top surface of the ladder connector;

a shelf comprising a shelf plate;

a shelf brace, wherein the shelf plate is mounted to the shelf brace; and a shelf bracket, wherein the shelf bracket extends from the shelf brace; and a shelf connector mounted to the shelf bracket, wherein the shelf connector includes a contact pad connected to a second wire, the contact pad formed of an electrically conductive material, wherein the contact pad abuts and rests on top of the spring-loaded contact pin to electrically connect the first wire to the second wire.

15. The shelf power system of claim 14, further comprising:

a second ladder;

a second ladder connector configured to mount to the second ladder, wherein the second ladder connector comprises a second spring-loaded contact pin electrically connected to a third wire configured to carry a second electrical signal, the second spring-loaded contact pin formed of the electrically conductive material and mounted to extend up from a top surface of the second ladder connector; and a second shelf connector configured to mount to a second shelf bracket, wherein the second shelf connector includes a second contact pad connected to a fourth wire, the second contact pad formed of the electrically conductive material, wherein the second contact pad abuts and rests on top of the second spring-loaded contact pin to electrically connect the third wire to the fourth wire when the second shelf bracket is mounted to the second ladder of the shelving system, wherein the shelf further comprises a second shelf brace and a second shelf bracket, wherein the shelf plate is further mounted to the second shelf brace, wherein the second shelf bracket extends from the second shelf brace.

16. The shelf power system of claim 15, wherein the ladder connector further comprises a third spring-loaded contact pin electrically connected to a fifth wire configured to carry a third electrical signal, the third spring-loaded contact pin formed of the electrically conductive material.

17. The shelf power system of claim 14, wherein the ladder connector further comprises a connector body and a cone, wherein the cone extends up from the connector body, wherein the spring-loaded contact pin extends up through and above a center of the cone, wherein the cone is formed of an insulating material, wherein the spring-loaded contact pin is depressed into the cone when the second shelf bracket is mounted to the second ladder of the shelving system.

18. A shelving system comprising:

a ladder;

a plurality of ladder connectors mounted to the ladder, wherein each ladder connector of the plurality of ladder connectors comprises a spring-loaded contact pin electrically connected to a first wire configured to carry an electrical signal, the spring-loaded contact pin formed of an electrically conductive material and mounted to extend up from a top surface of each ladder connector;

a shelf comprising a shelf plate;

a shelf brace, wherein the shelf plate is mounted to the shelf brace; and a shelf bracket, wherein the shelf bracket extends from the shelf brace; and a shelf connector mounted to the shelf bracket, wherein the shelf connector includes a contact pad connected to a second wire, the contact pad formed of an electrically conductive material, wherein the contact pad abuts and rests on top of the spring-loaded contact pin of a single ladder connector to electrically connect the first wire to the second wire.

19. The shelving system of claim 18, wherein the plurality of ladder connectors are connected in series, wherein each ladder connector further comprises a connector body, wherein the first wire is wound around a portion of the connector body of each ladder connector.

20. The shelving system of claim 18, wherein the plurality of ladder connectors are connected in series by a third wire, wherein each ladder connector further comprises a connector body, wherein the first wire is connected to a solder post mounted to the connector body, wherein the first wire of each ladder connector is split from the third wire.

* * * * *